US011297939B2

(12) United States Patent
Levy et al.

(10) Patent No.: US 11,297,939 B2
(45) Date of Patent: Apr. 12, 2022

(54) FOLDING TABLE WITH INCREASED SEATING SPACE

(71) Applicant: NPS Public Furniture Corp., Clifton, NJ (US)

(72) Inventors: Elliot Levy, Passaic, NJ (US); Charles P. Kiesow, Jersey City, NJ (US)

(73) Assignee: NPS Public Furniture Corp., Clifton, NJ (US)

( * ) Notice: Subject to any disclaimer, the term of this patent is extended or adjusted under 35 U.S.C. 154(b) by 0 days.

(21) Appl. No.: 16/998,764

(22) Filed: Aug. 20, 2020

(65) Prior Publication Data

US 2022/0053923 A1 Feb. 24, 2022

(51) Int. Cl.

| | |
|---|---|
| ***A47B 3/091*** | (2006.01) |
| ***A47B 13/06*** | (2006.01) |
| ***A47B 3/08*** | (2006.01) |

(52) U.S. Cl.

CPC ..... *A47B 3/0913* (2013.01); *A47B 3/0815* (2013.01); *A47B 13/06* (2013.01)

(58) Field of Classification Search

CPC ..... A47B 3/0815; A47B 3/091; A47B 3/0911; A47B 3/0912; A47B 3/0913; A47B 3/0917; A47B 3/0918; A47B 13/06

See application file for complete search history.

(56) References Cited

U.S. PATENT DOCUMENTS

| | | | | |
|---|---|---|---|---|
| 4,841,877 | A * | 6/1989 | Virtue | A47B 3/0912 108/167 |
| 2006/0000394 | A1* | 1/2006 | Stanford | A47B 3/091 108/132 |
| 2006/0021553 | A1* | 2/2006 | Pleiman | A47B 3/0815 108/133 |
| 2007/0199483 | A1* | 8/2007 | Peery | A47B 3/0912 108/132 |
| 2009/0293778 | A1* | 12/2009 | Branch | A47B 3/0918 108/131 |
| 2010/0175594 | A1* | 7/2010 | Leng | A47B 3/0913 108/50.11 |

* cited by examiner

*Primary Examiner* — Matthew W Ing
(74) *Attorney, Agent, or Firm* — Weiss & Arons LLP

(57) ABSTRACT

Methods for producing a folding table with increased seating space are provided. A method may include affixing a plurality of legs to an underside of a tabletop, and configuring the legs to be movable, bi-directionally, between an unfolded position and a folded position via multiple folding mechanisms. Installing each of the folding mechanisms may include affixing a central support bar to the underside of the tabletop via a hinged bracket, and securing a central portion of a transverse support bar assembly against the central support bar such that the central portion is configured to slide along the central support bar. A method may also include attaching one end of a first side support bar to the central portion, and another end to one of the legs, and attaching one end a second side support bar to the central portion, and another end to another one of the legs.

22 Claims, 27 Drawing Sheets

FOLDING TABLE WITH INCREASED SEATING SPACE

FIELD OF TECHNOLOGY

Aspects of the disclosure relate to functional mechanical designs and apparatus. Specifically, aspects of the disclosure relate to folding tables with improved utility.

BACKGROUND OF THE DISCLOSURE

Functional furniture plays an important role in everyday activities. Exemplary activities may relate to the workplace, the home, retail locations, office settings, educational locations, eateries, leisure, and any other imaginable activity that may utilize furniture such as a table.

Folding features may increase the utility of functional furniture such as a table. A folding table may be easily stowed away in a much smaller space than is occupied by the table when unfolded. Many conventional folding tables, however, are associated with substantially decreased strength relative to non-folding tables. Moreover, many conventional folding tables are associated with substantially decreased seating space relative to non-folding tables. The decreased seating space may at least partially result from tables legs and folding assemblies that infringe on the space where someone sitting at the table may want to position their knees and/or legs.

It would be desirable, therefore, to provide systems and methods for folding tables with increased seating space. It would be further desirable for the folding tables to be associated with increased structural strength.

SUMMARY OF THE DISCLOSURE

Aspects of the disclosure relate to a folding table with increased seating space. The table may include a tabletop. The table may include a plurality of legs affixed to an underside of the tabletop. The legs may be configured to be movable, bi-directionally, between an unfolded position and a folded position.

The table may include two or more folding mechanisms. Each folding mechanism may include a central support bar affixed to the underside of the tabletop via a hinged bracket. Each folding mechanism may also include a transverse support bar assembly.

The transverse support bar assembly may include a central portion configured to slide along the central support bar. The transverse support bar assembly may also include a first side support bar that extends from the central portion to one of the legs, and a second side support bar that extends from the central portion to another one of the legs.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

DETAILED DESCRIPTION OF THE DISCLOSURE

Figure 1:
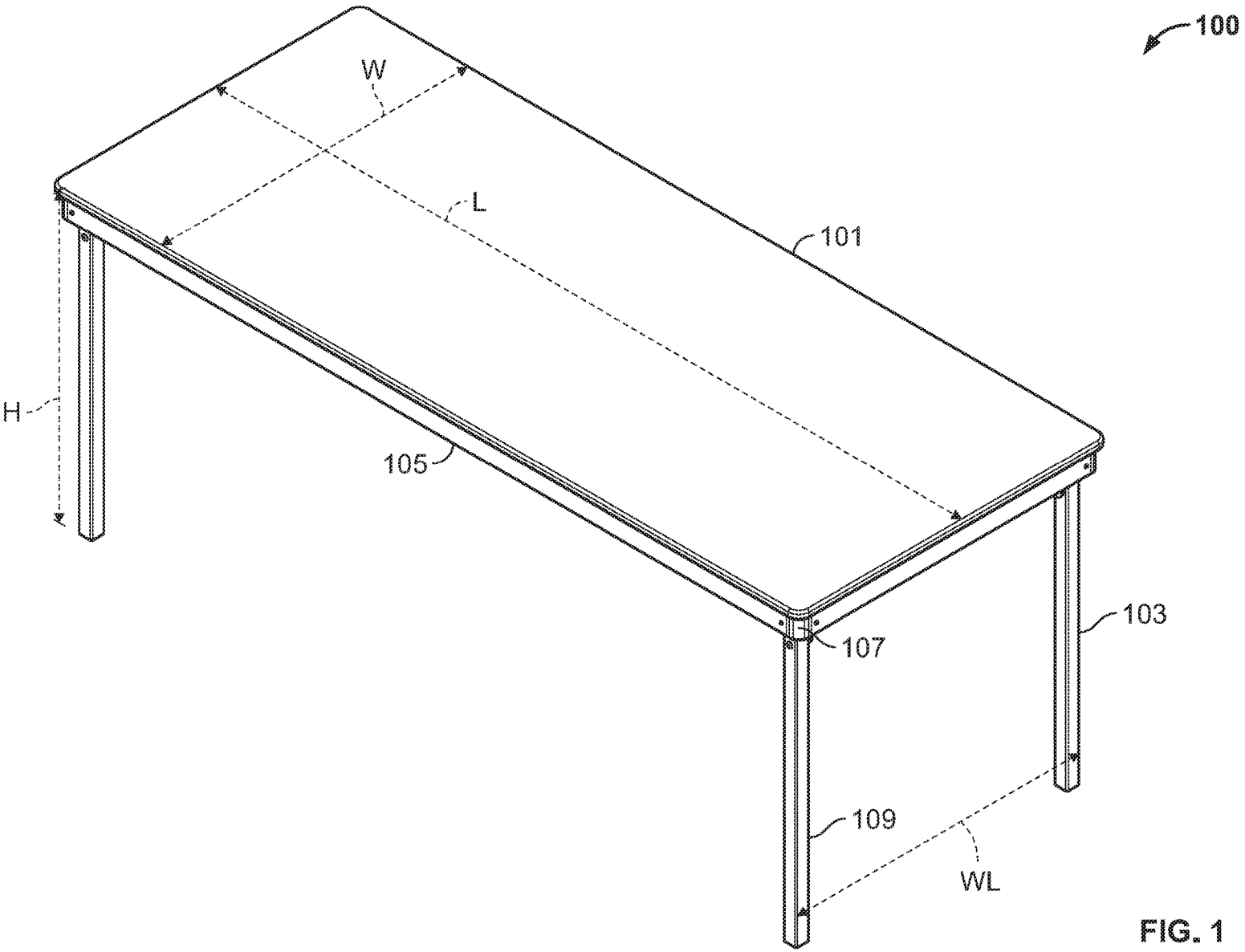
FIG. 1 shows an illustrative apparatus in accordance with principles of the disclosure.

A folding table with increased seating space is provided. The table may include a tabletop. The tabletop may be rectangular. In some embodiments, the tabletop may be circular, oval, square, or any suitable tabletop shape. The tabletop may, in certain embodiments, be made partly or wholly out of wood, plastic, or other suitable material, or a suitable combination thereof.

The table may include a plurality of legs affixed to an underside of the tabletop. The legs may be configured to be movable, bi-directionally, between an unfolded position and a folded position.

In some embodiments of the table, the plurality of legs may be four legs. The legs may, in certain preferred embodiments, be straight. Straight legs may in certain embodiments, be completely or substantially straight. In some embodiments, straight legs may be legs that do not form a wishbone shape in pairs.

The tabletop may define four corners. Each corner may be adjacent to a perimeter of the tabletop. When the tabletop is rectangular, the four corners may, for example, be adjacent to the four corners of the rectangular perimeter. When the tabletop is circular, the four corners may be adjacent to the four corners of a rectangle that is inscribed by the circular perimeter. Being adjacent to the perimeter may include being within one, two, three, four, five, or any other suitable relatively small number of inches from the perimeter. Each one of the four legs may be situated at one of the four corners.

In certain embodiments, a first one of the legs may be connected to a second one of the legs via a first connecting bar. The first one of the legs may be situated at a first one of the corners. The second one of the legs may be situated at a second one of the corners. The first connecting bar may be situated against the underside of the tabletop and may extend from the first one of the legs at the first one of the corners to the second one of the legs at the second one of the corners.

In some embodiments, the first connecting bar may be secured against the underside of the tabletop via one or more braces. The braces may allow the first connecting bar to rotate in place. Rotation of the first connecting bar may allow the first and the second legs to move, in unison, between the folded and unfolded positions.

A third one of the legs may be connected to a fourth one of the legs via a second connecting bar. The third one of the legs may be situated at a third one of the corners. The fourth one of the legs may be situated at a fourth one of the corners. The second connecting bar may be situated against the underside of the tabletop and may extend from the third one of the legs at the third one of the corners to the fourth one of the legs at the fourth one of the corners.

In certain embodiments, the second connecting bar may be secured against the underside of the tabletop via one or more braces. The braces may allow the second connecting bar to rotate in place. Rotation of the second connecting bar may allow the third and the fourth legs to move, in unison, between the folded and unfolded positions.

In some embodiments, the first and the second connecting bars may form the only connections between the legs.

The table may include two or more folding mechanisms. The folding mechanisms may, in certain embodiments, be formed from steel, aluminum, or other suitable material or combination of materials. Each folding mechanism may include a central support bar affixed to the underside of the tabletop via a hinged bracket. The central support bar may be a hollow tube. The central support bar may be square.

Each folding mechanism may also include a transverse support bar assembly. The transverse support bar assembly may include a central portion configured to slide along the central support bar. The central portion may be a hollow shape (e.g., square) configured to fit around the central support bar.

The transverse support bar assembly may also include a first side support bar that extends from the central portion to one of the legs, and a second side support bar that extends from the central portion to another one of the legs.

In certain embodiments of the table, the first side support bar may be a straight bar that forms an acute angle at a point of attachment with the central portion. The second side support bar may also be a straight bar that forms an acute angle at a point of attachment with the central portion. The transverse support bar assembly thus may form a V-shape.

In certain embodiments, each of the first and second side support bars may attach to one of the legs. The attachment may, in some embodiments, be an offset attachment. The point of attachment may (offset or otherwise) be within four inches, or two, three, five, six, or other number of inches or percentage of the leg, below the underside of the tabletop when the legs are in the unfolded position. The folding mechanisms may thereby be associated with a low profile. Low-profile folding mechanisms may increase the space for knees and legs of a person seated at the table. The table may thereby be more comfortable and useful to those using the table. The table may also thereby seat more people than conventional folding tables without low-profile folding mechanisms.

In some embodiments, the first and second side support bars may be tubes (hollow or otherwise). The tubes may, in certain preferred embodiments, be square. In other embodiments, the tubes may be circular. Tubular side support bars may provide increased structural strength over flat side support bars. Increased structural strength may contribute to enabling the low profile of the folding mechanism while maintain sufficient strength to support the table.

The table may, in certain embodiments, include a pin assembly. The pin assembly may be configured to lock the central portion of the transverse support bar assembly in place against the central support bar when the legs are in the unfolded position.

The table may, in some embodiments, include a skirt assembly. A skirt assembly may also be referred to as an apron assembly. The skirt assembly may substantially follow a perimeter of the tabletop. The skirt assembly may extend below the underside of the tabletop such that when the legs are in the folded position the skirt assembly extends beyond the legs. The skirt assembly may, in certain preferred embodiments, include enlarged corner portions. The enlarged corner portions may be made of plastic or another suitable material that may minimize scratching or other damage. The enlarged corner portions may extend further down than the rest of the skirt assembly. The skirt assembly may thereby minimize scratching of a top surface of another tabletop upon which (or under which, if upside down) the folding table is stacked.

Methods for producing a folding table with increased seating space are provided. A method may include affixing a plurality of legs to an underside of a tabletop, and configuring the legs to be movable, bi-directionally, between an unfolded position and a folded position via multiple folding mechanisms. Installing each of the folding mechanisms may include affixing a central support bar to the underside of the tabletop via a hinged bracket, and securing a central portion of a transverse support bar assembly against the central support bar such that the central portion is configured to slide along the central support bar. A method may also include attaching one end of a first side support bar to the central portion, and another end to one of the legs, and attaching one end a second side support bar to the central portion, and another end to another one of the legs.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure.

FIG. 1 shows illustrative folding table 100 in accordance with principles of the disclosure. Table 100 includes tabletop 101, legs 103 and 109, and skirt assembly 105 (including corner portion 107). Table 100 shows a view of one preferred embodiment of the disclosed table with the legs in the unfolded position. The view shows that the legs may be straight, and they may be located at the corners of the table, very close to the edge. The view further shows that with a low-profile folding assembly, the assembly may not be visible from a slightly angled view such as the view in FIG. 1. Moreover, it is shown that there is no visible connection structure between legs 103 and 109. The disclosed low-profile folding assembly may be strong enough to support tabletop 101 and legs 103 and 109, and eliminate the need for connection structures between the legs that infringe on seating space. The only connective structure between the legs may be a connecting bar situated against the underside of tabletop 101, and the connecting bar may be hidden behind skirt assembly 105. These features provide increased leg and knee space for a user, translating into a table with increased usefulness and utility.

FIG. 1 also shows table 100 with dimensions of one illustrative embodiment. The dimensions include a length (L) of approximately 72 inches, a width (W) of approximately 30 inches, and a height (H) of approximately 30 inches. A width measured between the outsides of two legs (WL) across the width of the table may be approximately 27 inches. Approximate measurements may, in certain embodiments, be within 1 inch of the exact measurement. Exact measurements may, in one preferred embodiment, be L=71.8, W=29.8, WL=27.2, and H 29.15. It should be appreciated that according to these illustrative dimensions, the legs are situated approximately 1.3 inches away from the perimeter of the tabletop.

Other illustrative dimensions may include (W×L): 18"×60", 18"×72", 18"×96", 24"×48", 24"×60", 24"×72", 24"×96", 30"×60", 30"×96", 36"×60", 36"×72", 36"×96".

Illustrative round table dimensions may include: 48" Round, 60" Round, and 72" Round. Dimensions of a round table may be measured as the diameter across the tabletop.

Figure 2:
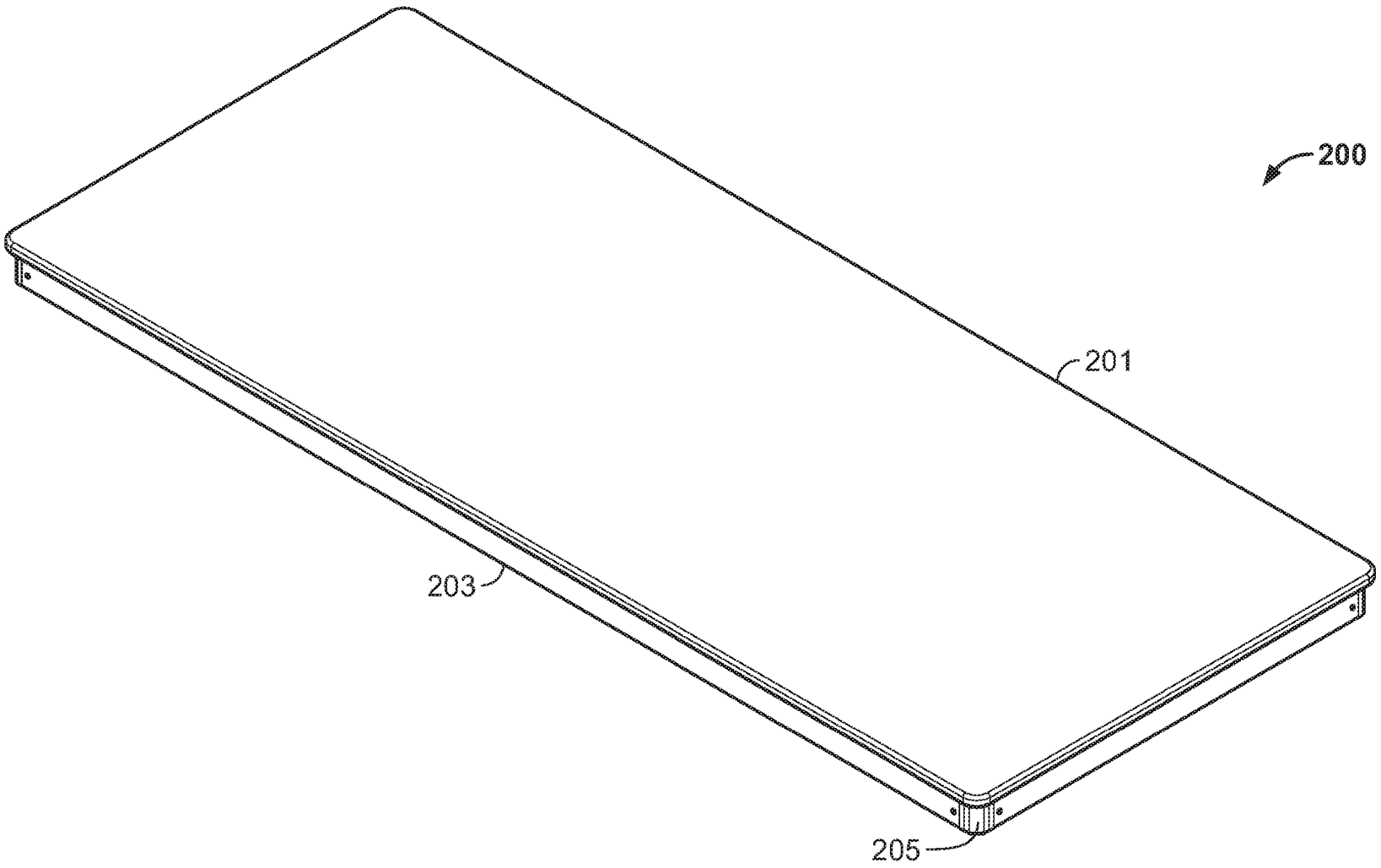
FIG. 2 shows another illustrative apparatus in accordance with principles of the disclosure.

FIG. 2 shows illustrative folding table 200 in accordance with principles of the disclosure. Table 200 may be essentially the same as table 100 shown in FIG. 1, but table 200 is shown with its legs in the folded position. Table 200 includes tabletop 201, skirt assembly 203, and corner portions 205. Table 200 shows that when the legs are folded, the legs may not extend beyond skirt assembly 203. This by itself, and especially in conjunction with corner portions 205, may decrease scratching and otherwise damaging other surfaces upon which the table may be stacked, such as other tables.

Figure 3A:
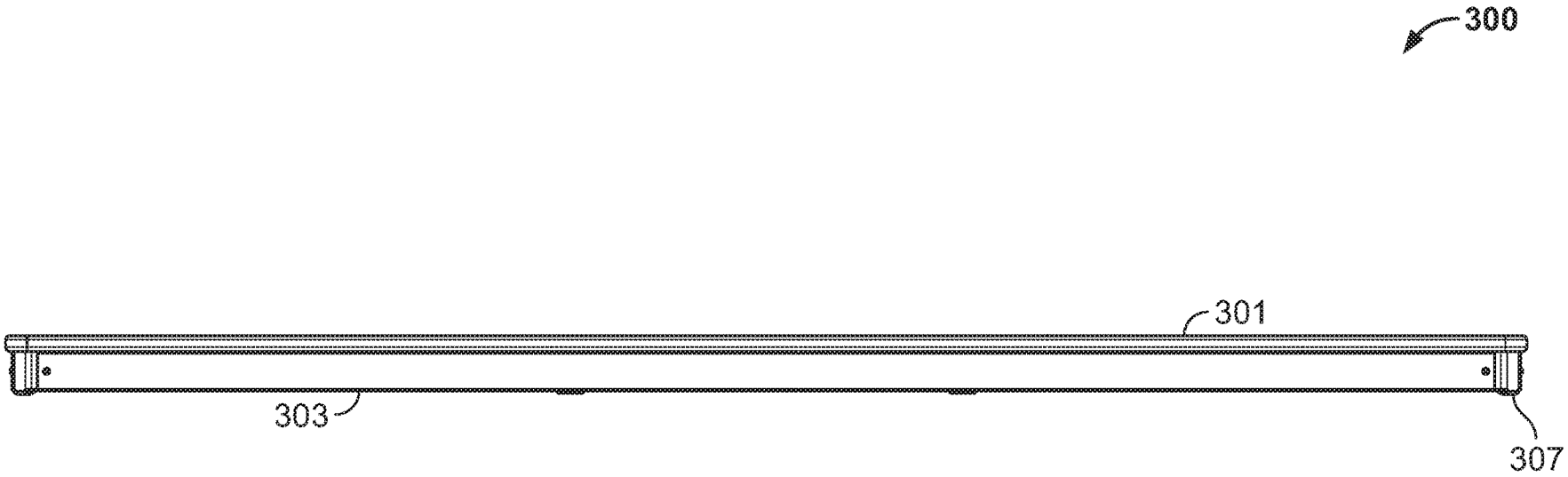
FIGS. 3A and 3B show yet another illustrative apparatus in accordance with principles of the disclosure.
Figure 3B:
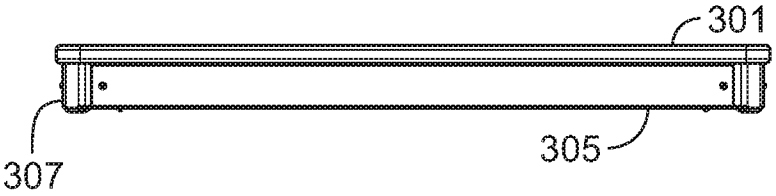
Figure 4:
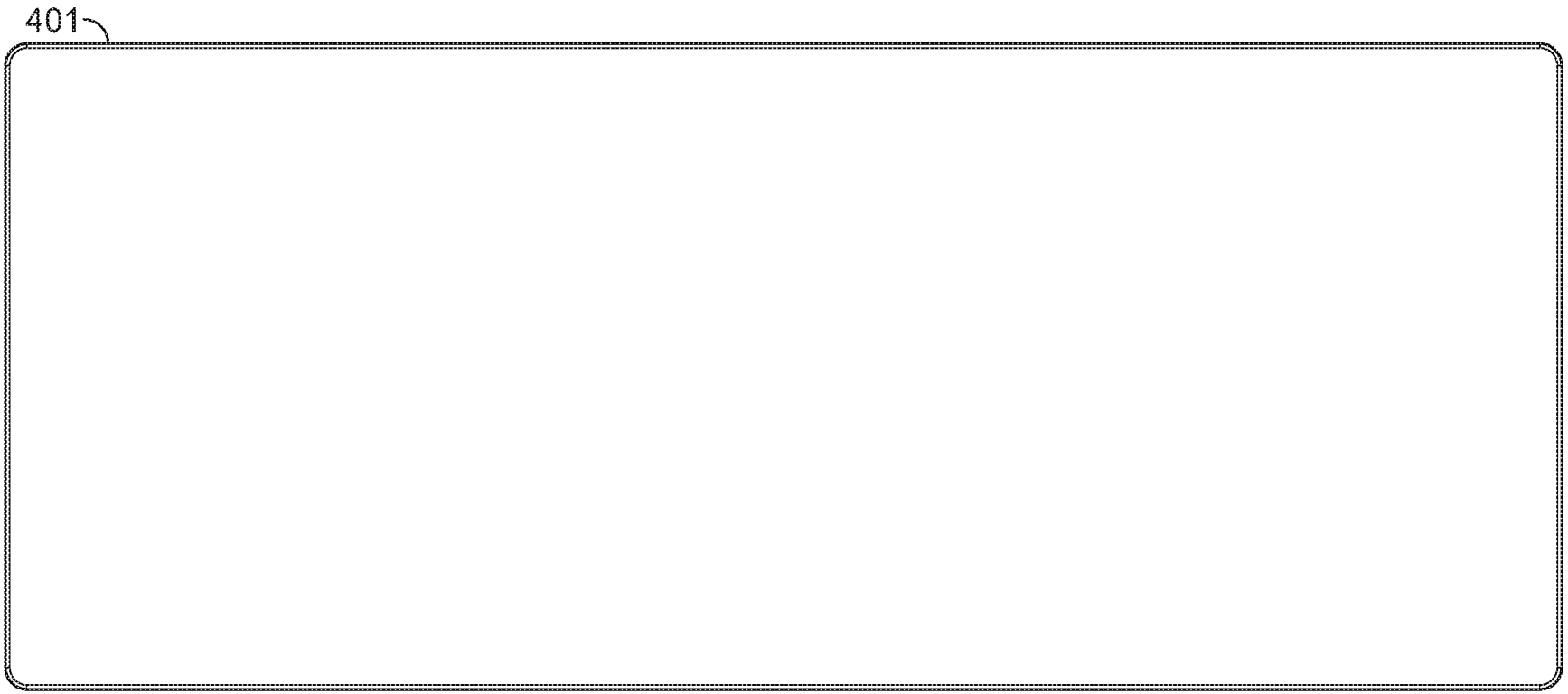
FIG. 4 shows still another illustrative apparatus in accordance with principles of the disclosure.

FIGS. 3A and 3B show two side views of illustrative folding table 300 in accordance with principles of the disclosure. Table 300 is shown with legs in the folded position. Table 300 includes tabletop 301. Tabletop 301 may be rectangular shaped, similar to rectangular shaped tabletop 401 shown in a top view of illustrative table 400 in FIG. 4.

Table 300 also includes a skirt assembly. FIG. 3A shows a side view of the length of table 300, including the lengthwise portion 303 of the skirt assembly. FIG. 3B shows a side view of the width of table 300, including the widthwise portion 305 of the skirt assembly. Both side views shown in FIGS. 3A and 3B show that when the legs are folded, the legs may not extend beyond the skirt assembly. Both side views shown in FIGS. 3A and 3B also show corner portion 307. It is shown that corner portion 307 (which may be similarly placed on all four corners of the skirt assembly of table 300) may extend below portions 303 and 305 of the skirt assembly.

Figure 5A:
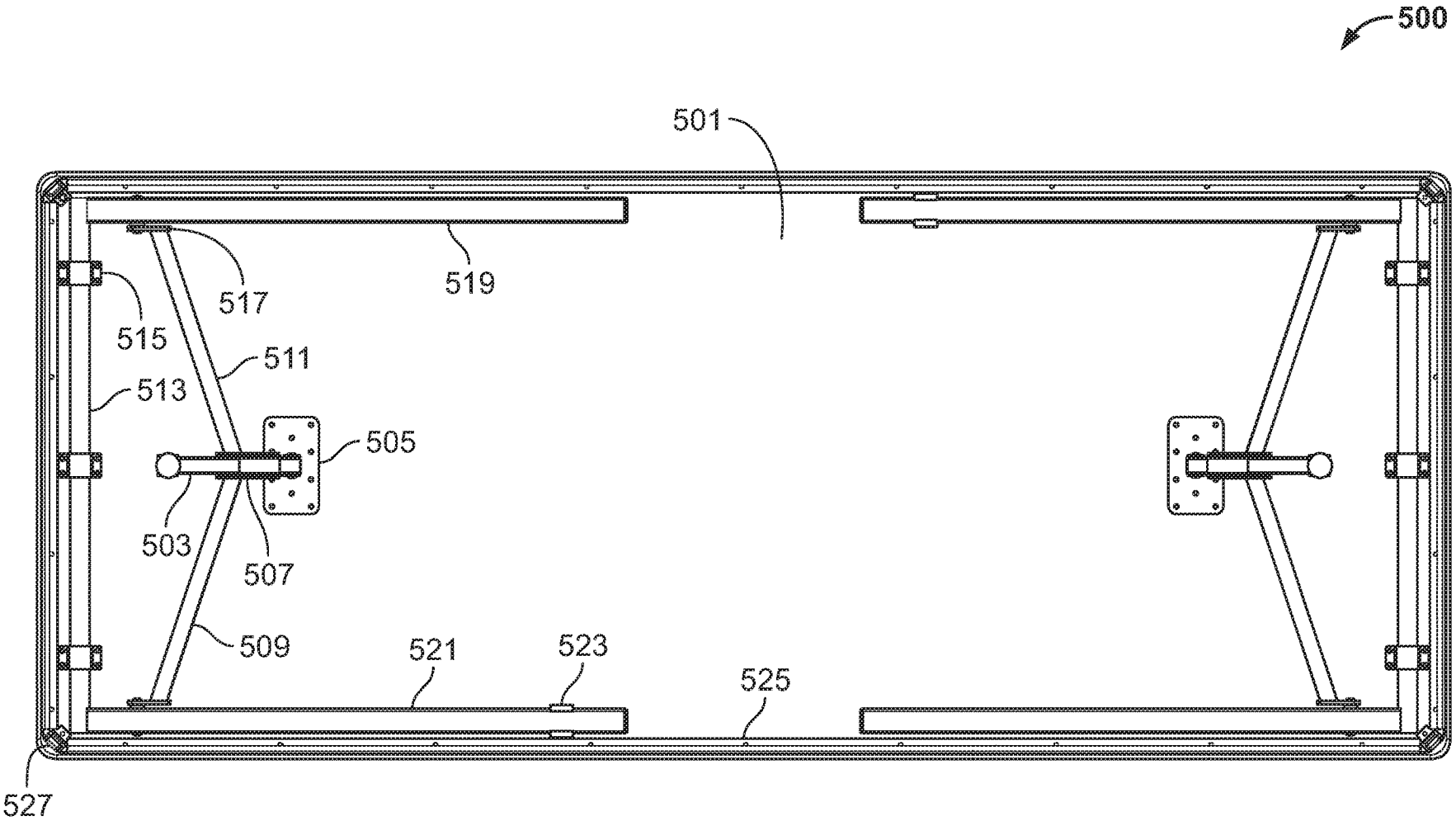
FIGS. 5A and 5B show an illustrative apparatus in accordance with principles of the disclosure.
Figure 5B:
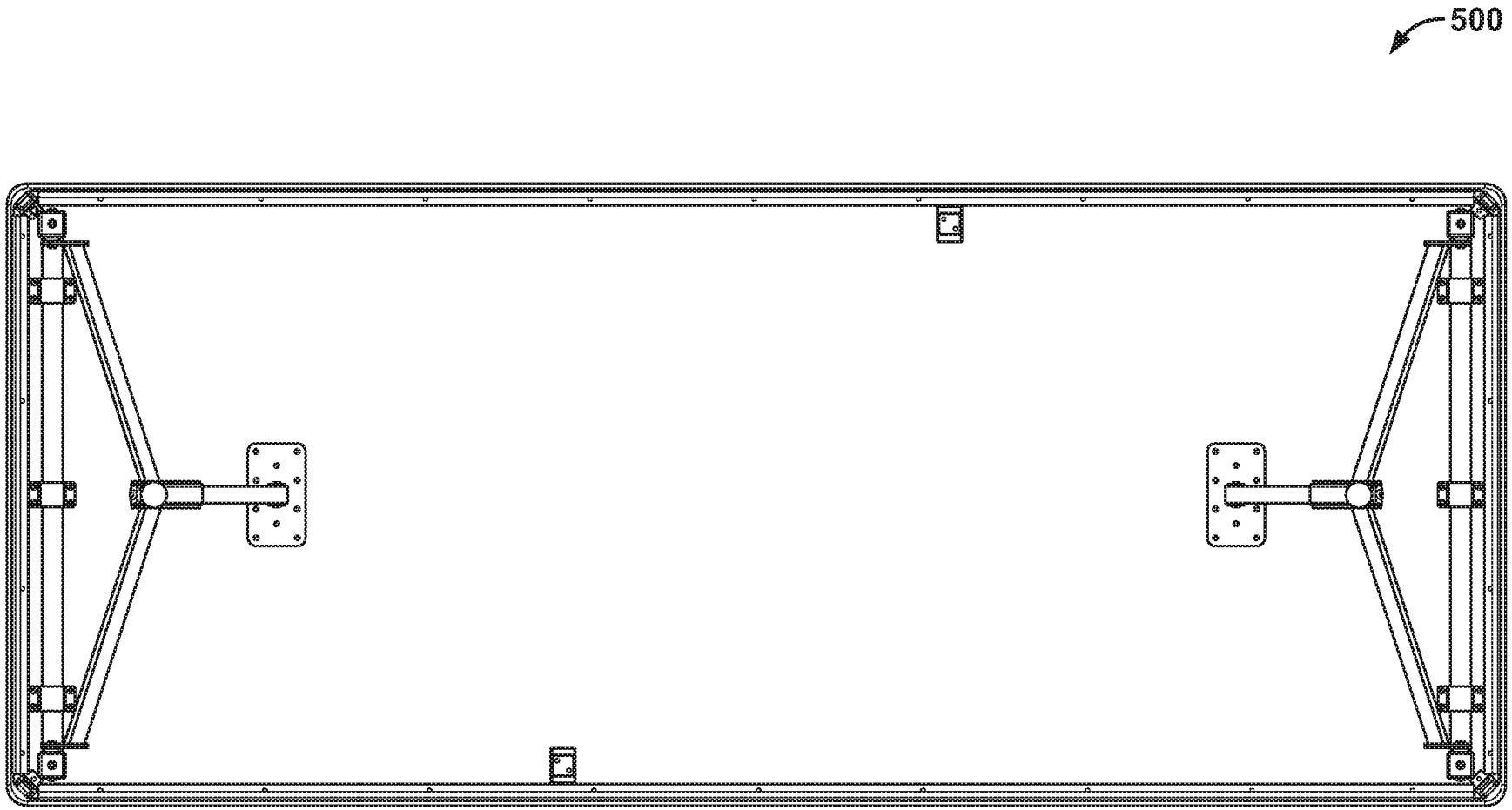

FIGS. 5A and 5B show a bottom view of illustrative folding table 500 in accordance with principles of the disclosure. The view in FIG. 5A shows table 500 with its legs in the folded position, and the view in FIG. 5B shows table 500 with its legs in the unfolded position.

Table 500 includes the underside 501 of the tabletop. Central support bar 503 is shown affixed to underside 501 via hinged bracket 505. Central portion 507 is shown as configured to slide along central support bar 503. First side support bar 509 is shown extending from central portion 507 to leg 521. Second side support bar 511 is shown extending from central portion 507 to leg 519. Components 507-511 may be part of the transverse support bar assembly, which, together with components 503 and 505 may form part of one of the folding mechanisms of table 500.

Table 500 also includes connecting bar 513, which is shown connecting legs 519 and 521. Connecting bar 513 is shown secured by at least one brace 515 (table 500 is shown in a preferred configuration with three braces securing each connecting bar). Connecting bar 513 may be configured to rotate in place. Rotation of connecting bar 513 may result from, and allow, transition of legs 519 and 521 between folded and unfolded positions.

Table 500 shows that the point of connection 517 between the side support bars and the legs may be offset. The offset connection may allow for the folding mechanism to extend and retract when the legs transition between folded and unfolded positions.

Table 500 also shows that point of connection 517 may be close to the top end of the leg, i.e., close to underside 501 when the legs are unfolded. In some embodiments, point of connection 517 may be within two inches of underside 501 when the legs are unfolded. Point of connection 517 may be within one inch of the bottom of skirt assembly 525 when the legs are unfolded. In other embodiments, point of connection 517 may be within three, four, five, six, seven, eight, nine, ten, or any other suitable number of inches of underside 501 when the legs are unfolded. In other embodiments, the closeness may be measured as a percentage of the length of the leg. For example, point of connection 517 may be within $1/15^{th}$ of leg away from underside 501 when the legs are unfolded. In other embodiments, point of connection 517 may be within $1/14^{th}$, $1/13^{th}$, $1/10^{th}$, $1/9^{th}$, $1/8^{th}$, $1/7^{th}$, $1/6^{th}$, $1/5^{th}$, $1/4^{th}$, or other suitable percentage of the leg away from underside 501 when the legs are unfolded.

Table 500 also includes securing clasp 523. Securing clasp 523 may secure the legs in the folding position. Table 500 also shows corner portions 527 of skirt assembly 525.

Figure 6A:
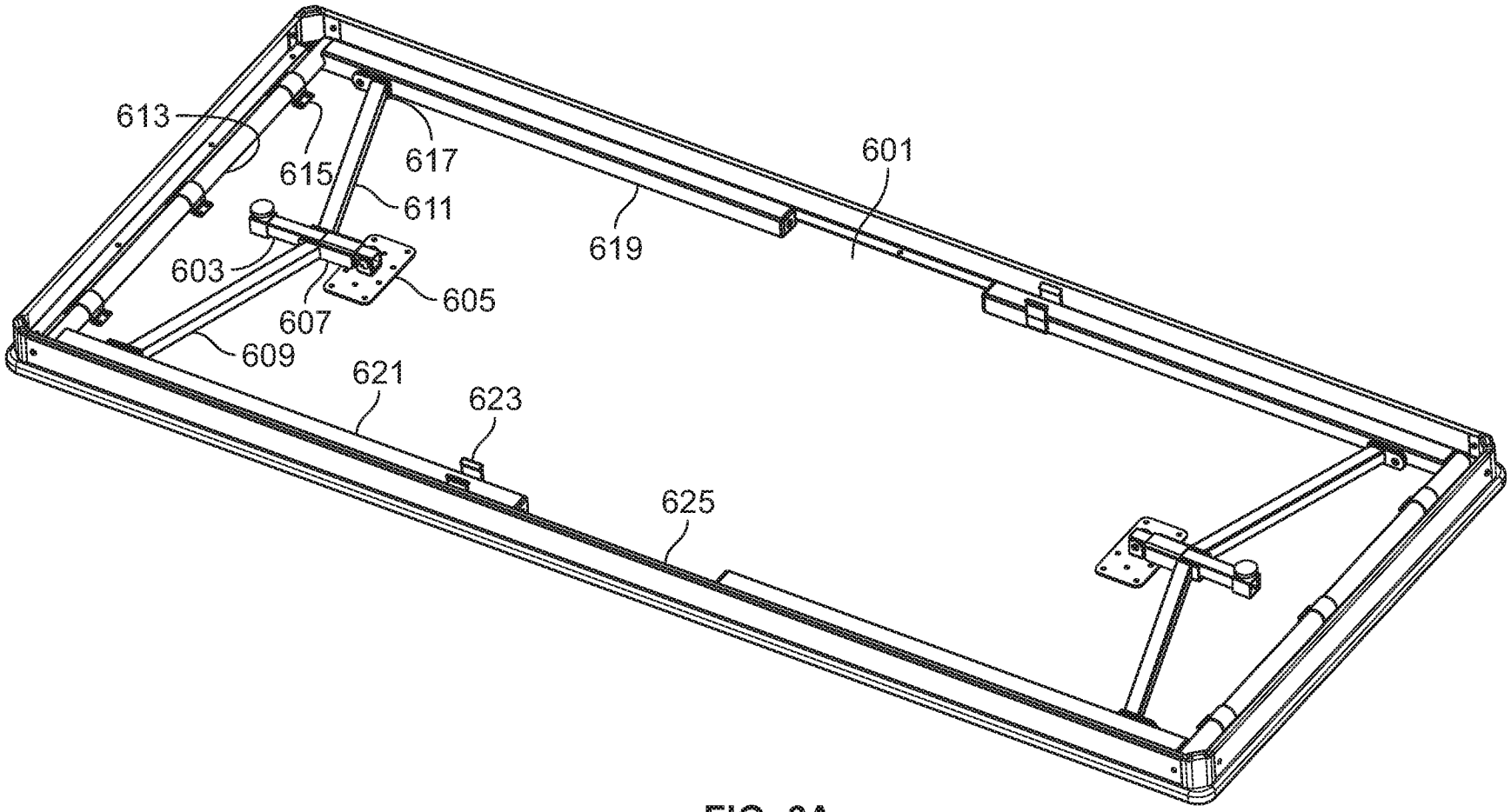
FIGS. 6A and 6B show another illustrative apparatus in accordance with principles of the disclosure.
Figure 6B:
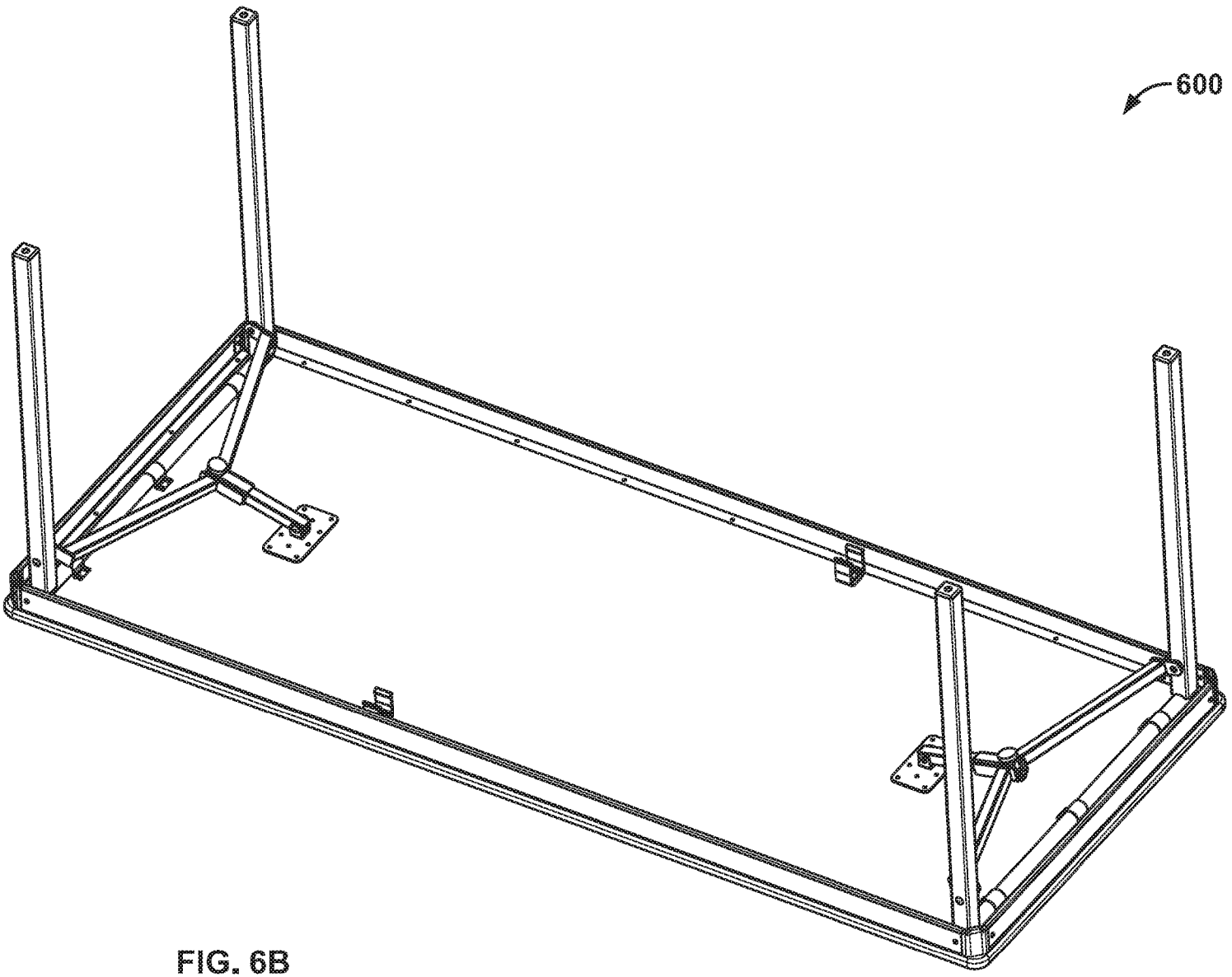

FIGS. 6A and 6B show a tilted side view of illustrative folding table 600 in accordance with principles of the disclosure. The view in FIG. 6A shows table 500 with its legs in the folded position, and the view in FIG. 6B shows table 600 with its legs in the unfolded position. The components of table 600 may be substantially the same as the components of table 500 shown in FIGS. 5A and 5B.

Figure 7:
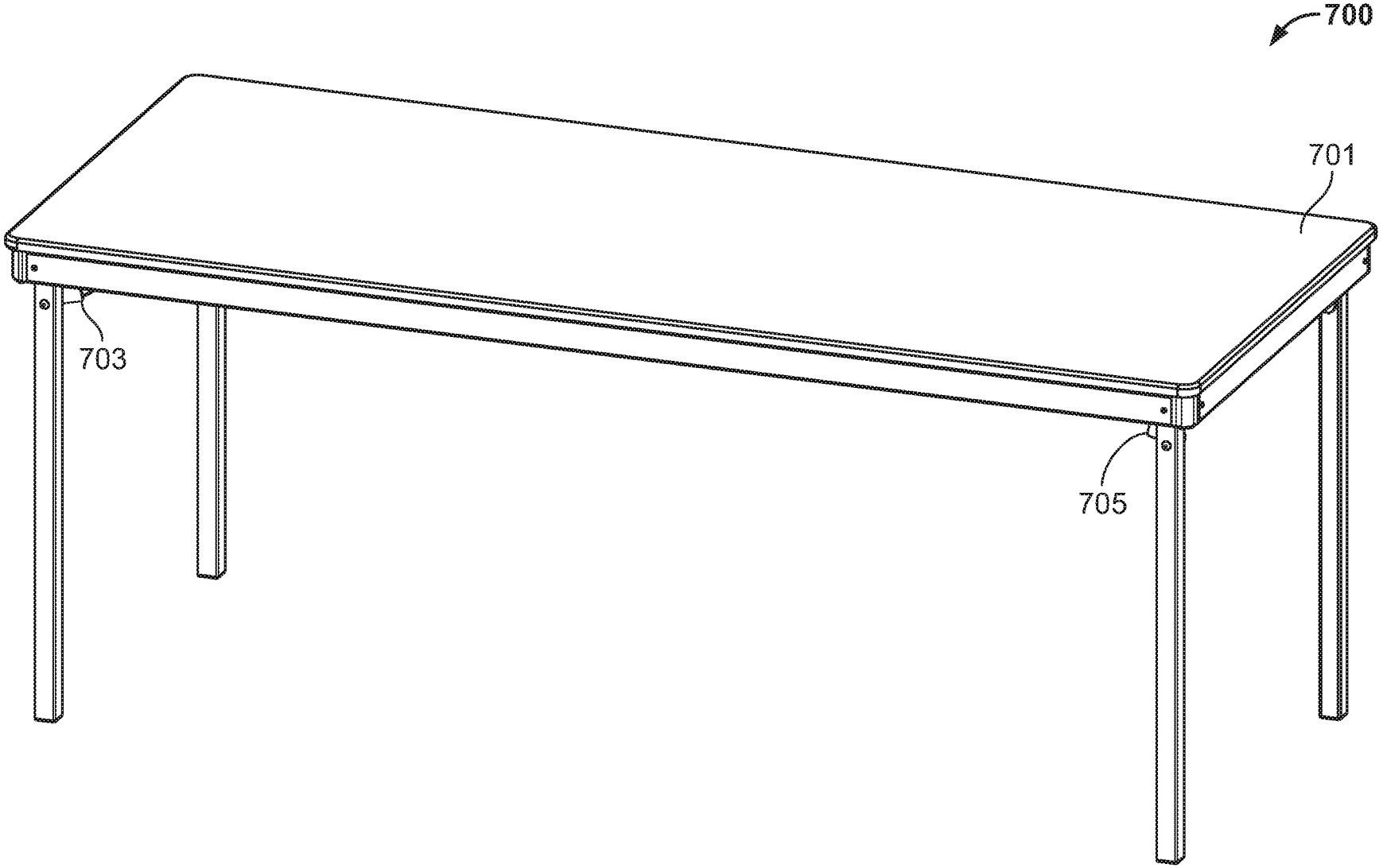
FIG. 7 shows yet another illustrative apparatus in accordance with principles of the disclosure.

FIG. 7 shows illustrative folding table 700 in accordance with principles of the disclosure. Table 700 includes tabletop 701. Table 700 shows a view of one preferred embodiment of the disclosed table with the legs in the unfolded position. Table 700 shows points of connections 703 and 705 where side support bars connect to the legs of table 700.

The view in FIG. 7 shows that points of connections 703 and 705 may be very close to the underside of tabletop 701, thereby providing a low-profile folding assembly. A low-profile folding assembly provides increased leg and knee space for a user, translating into a table with increased usefulness and utility. Other features that may contribute to providing increased seating space for a user include straight legs situated at the corners of the table, and no cross bars or other connections between the legs that infringe on seating space. The connecting bars described and shown herein may be secured against the underside of the table, and may therefore not infringe on seating space.

Figure 8A:
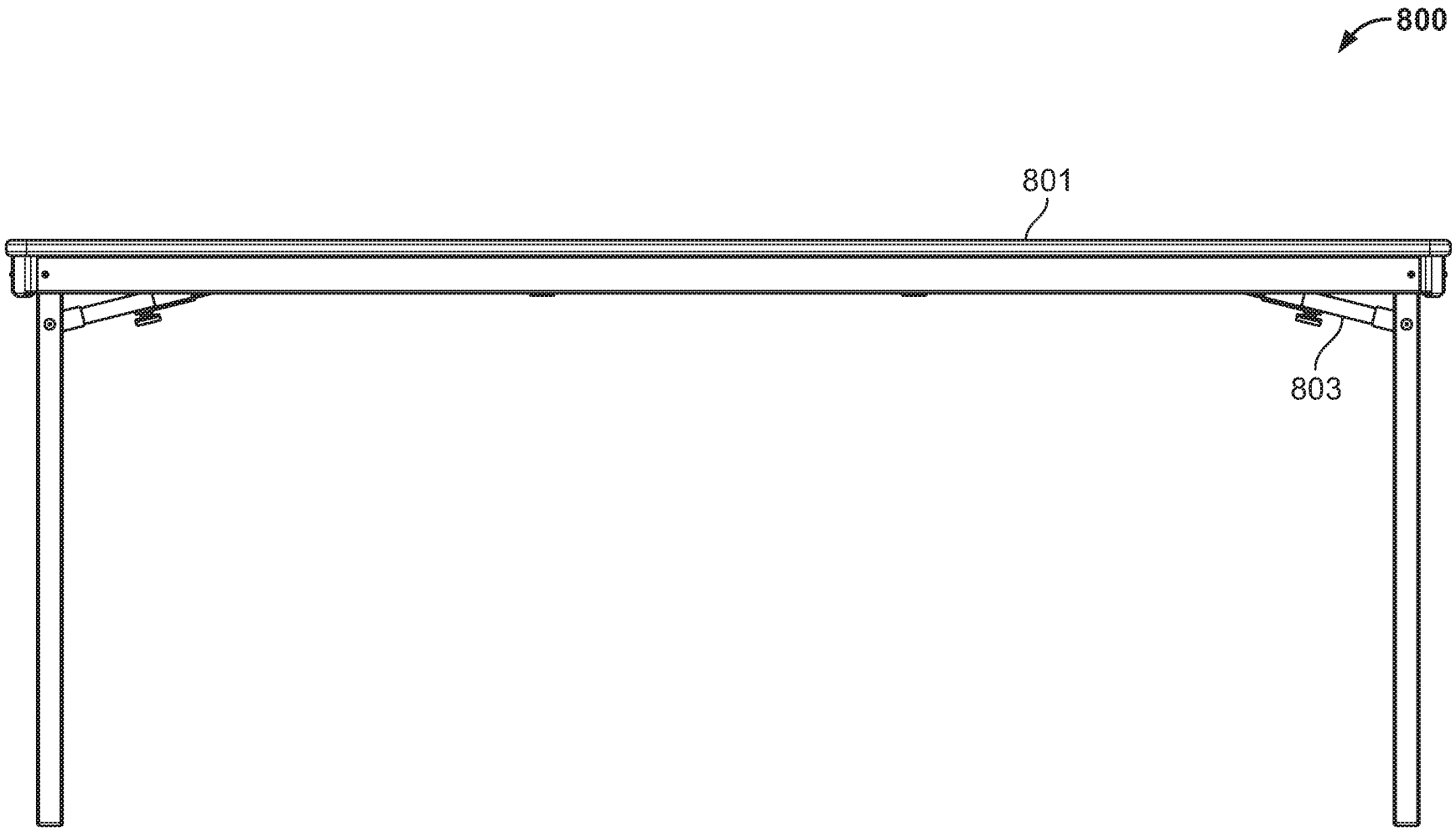
FIGS. 8A and 8B show still another illustrative apparatus in accordance with principles of the disclosure.
Figure 8B:
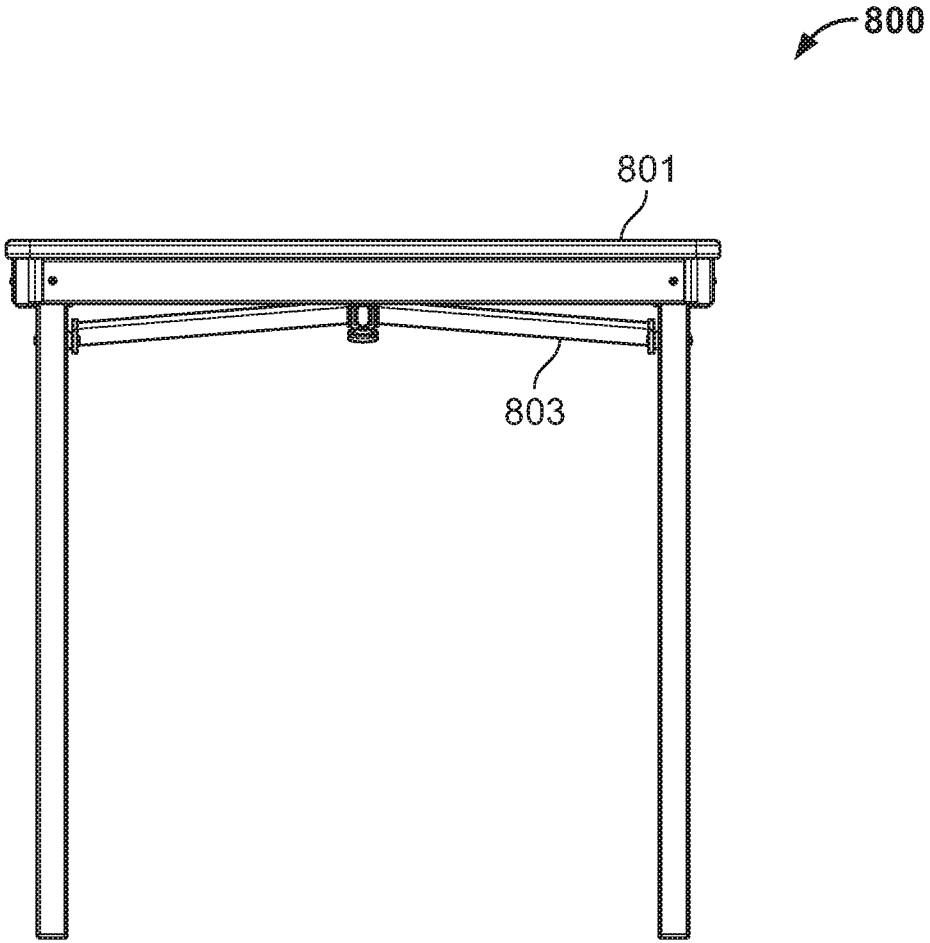

FIGS. 8A and 8B show two side views of illustrative folding table 800 in accordance with principles of the disclosure. Table 800 is shown with legs in the unfolded position. Table 800 includes tabletop 801. Tabletop 801 may be rectangular shaped, similar to rectangular shaped tabletop 401 shown in a top view of illustrative table 400 in FIG. 4.

Table 800 also includes a folding mechanism 803. FIG. 8A shows a side view of the length (i.e., the side) of table 800, and FIG. 3B shows a side view of the width (i.e., the end) of table 800. Both side views shown in FIGS. 8A and 8B show that even when the legs are unfolded, folding mechanism 803 is low-profile and extends very minimally, or not at all, into the seating space at the end or the side of table 800.

Figure 9A:
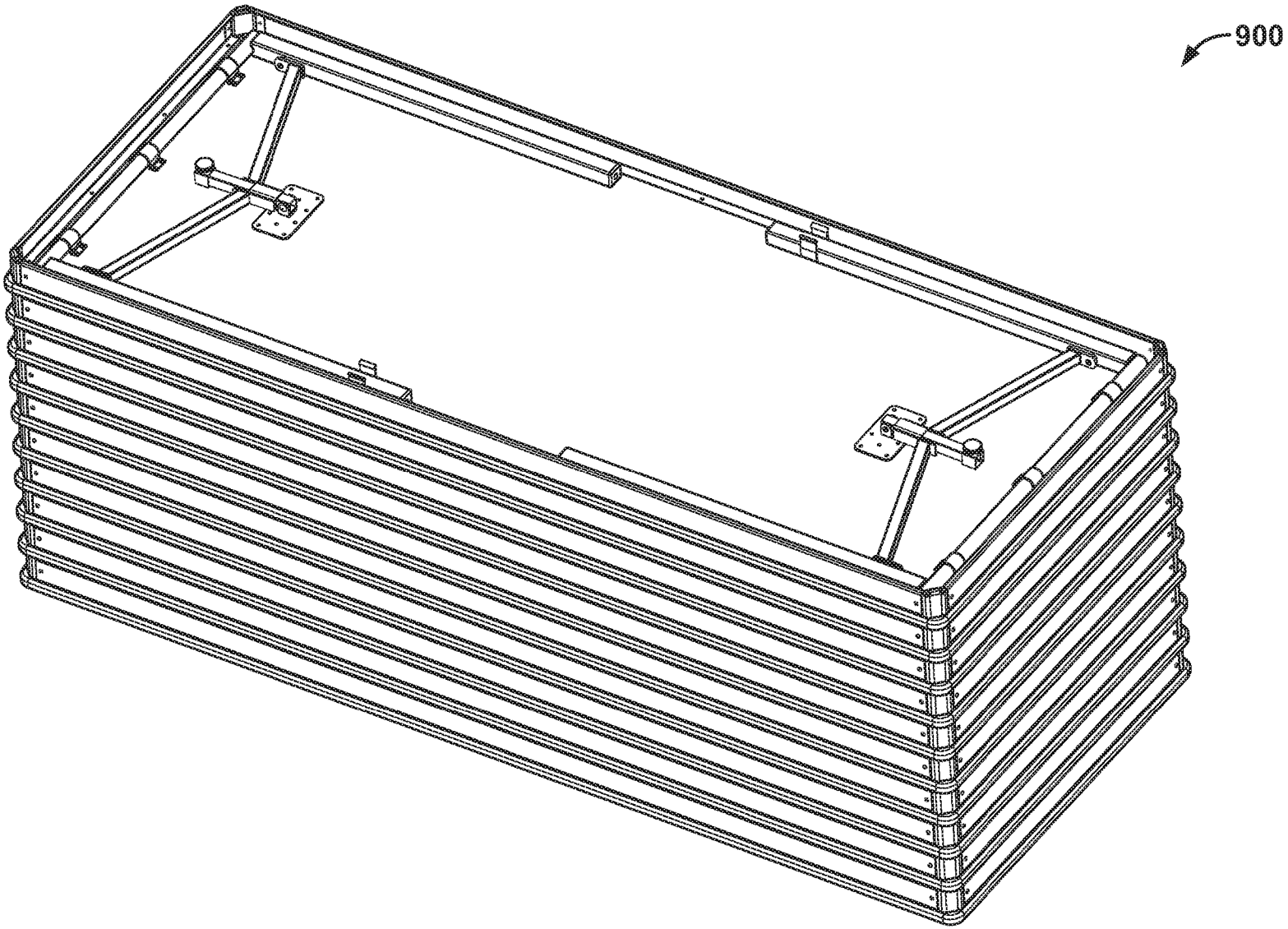
FIGS. 9A and 9B show an illustrative apparatus in accordance with principles of the disclosure.
Figure 9B:
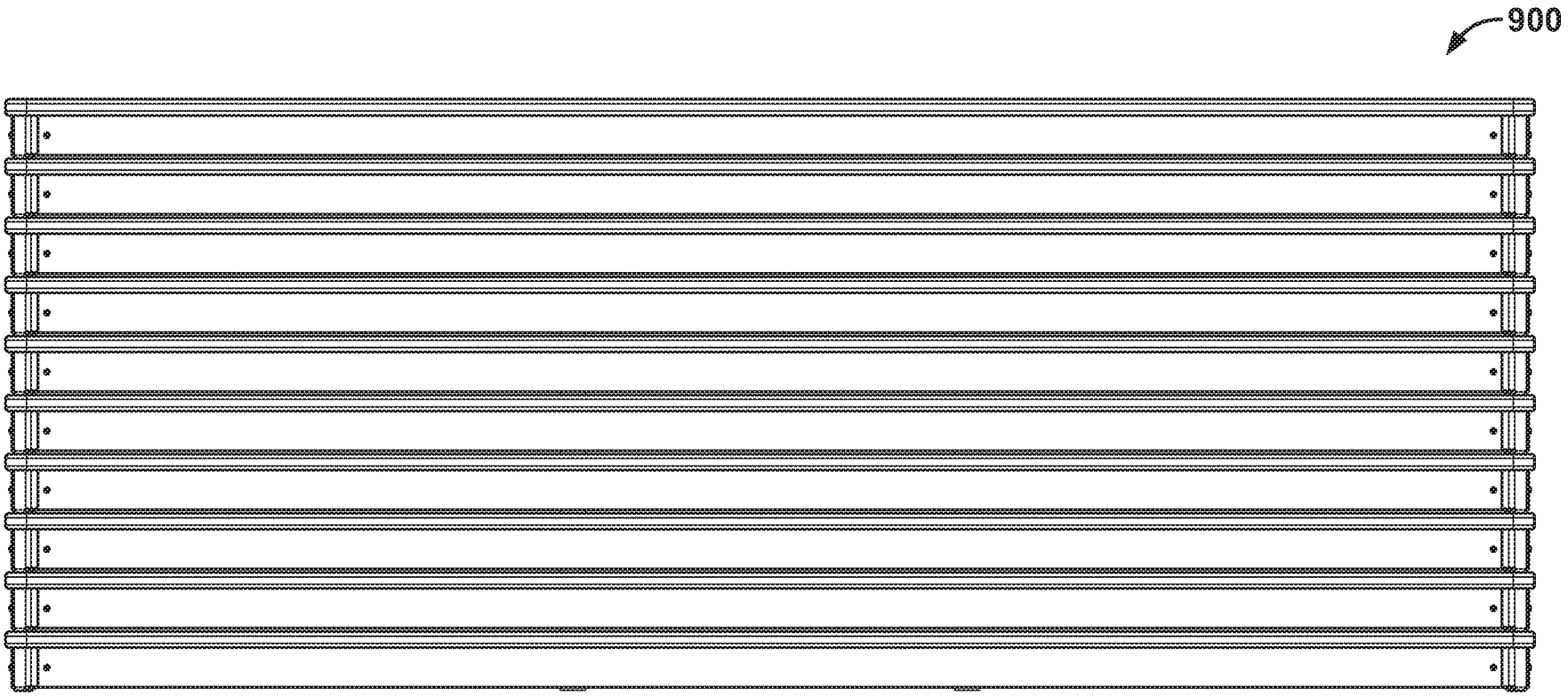

FIGS. 9A and 9B show two views of a stack 900 of illustrative folding tables in accordance with principles of the disclosure. Stack 900 shows that when the legs of the tables are folded, the legs are within the skirt assemblies. This decreases or eliminates scratching or other damage that may have occurred due to the hardware components (such as the legs and folding assemblies) of one table that would have been in direct contact with a damageable surface, such as the tabletop of the folded table below or above, if not for the legs being within the skirt assemblies.

Figure 10:
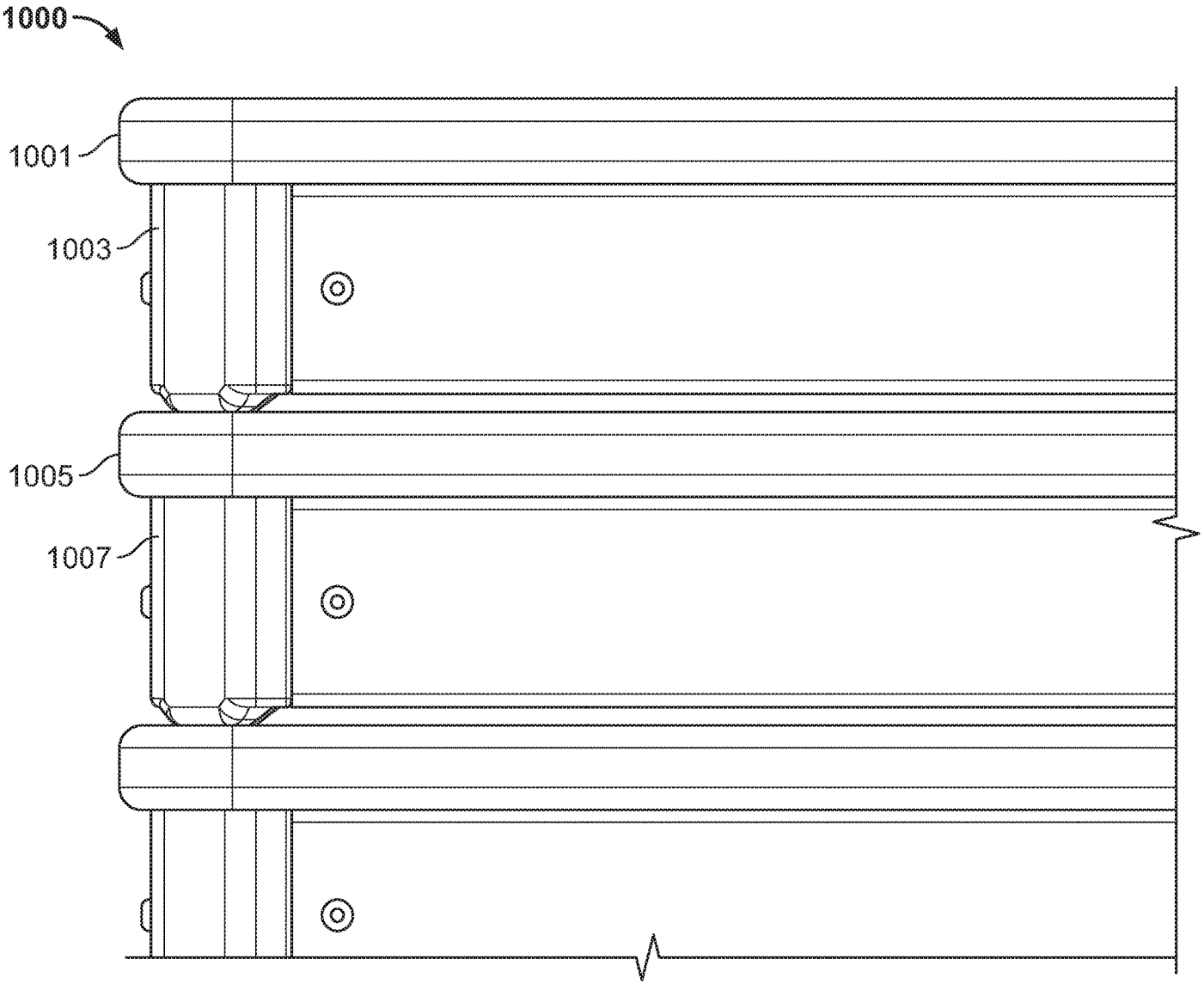
FIG. 10 shows another illustrative apparatus in accordance with principles of the disclosure.

FIG. 10 shows a closer view of stack 1000 of illustrative folding tables 1001 and 1005 in accordance with principles of the disclosure. The closer view shows that in some preferred embodiments, the skirt assemblies may include corner portions 1003 and 1007. The corner portions may extend further down than the side and/or end portions of the skirt assemblies. This may further reduce damage to a surface below. The reduction in damage may be partially due to reduced footprint of the folded table, which reduces the surface area that is in contact with the surface underneath. The reduction in damage may be partially due to a material (e.g., plastic) used for the corner portions that may minimize scratching.

Figure 11:
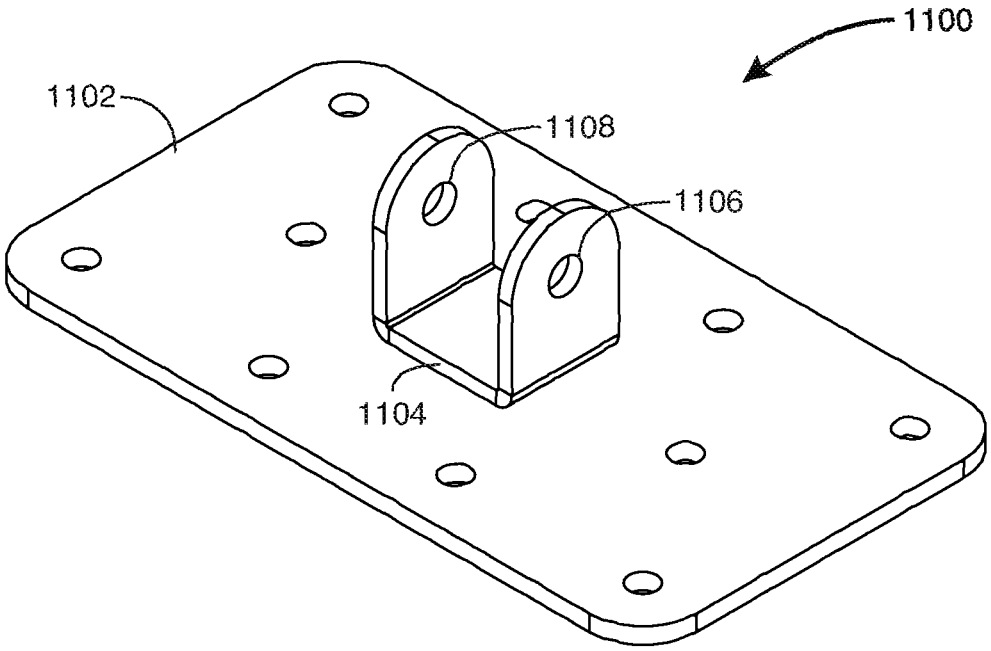
FIG. 11 shows another illustrative apparatus in accordance with principles of the disclosure.

FIG. 11 shows illustrative hinged bracket 1100 in accordance with principles of the disclosure. Bracket 110 may be secured to an underside of the tabletop via screws or other suitable fasteners through one or more of holes shown in baseplate 1102. Hinge portion 1104, via holes 1106 and 1108 therein, may connect to the central support bar (e.g., fastened via holes, such as holes 1214 shown in FIG. 12A or holes 1310 shown in FIG. 13). The connection may allow the central support bar rotational movement.

Figure 12A:
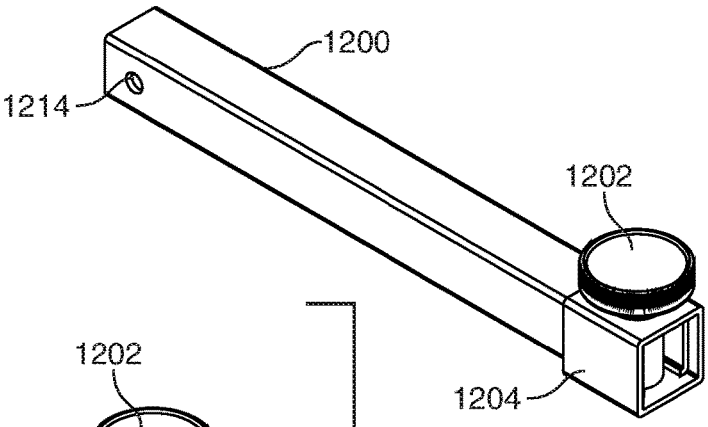
FIGS. 12A-12E show another illustrative apparatus in accordance with principles of the disclosure.
Figure 12B:
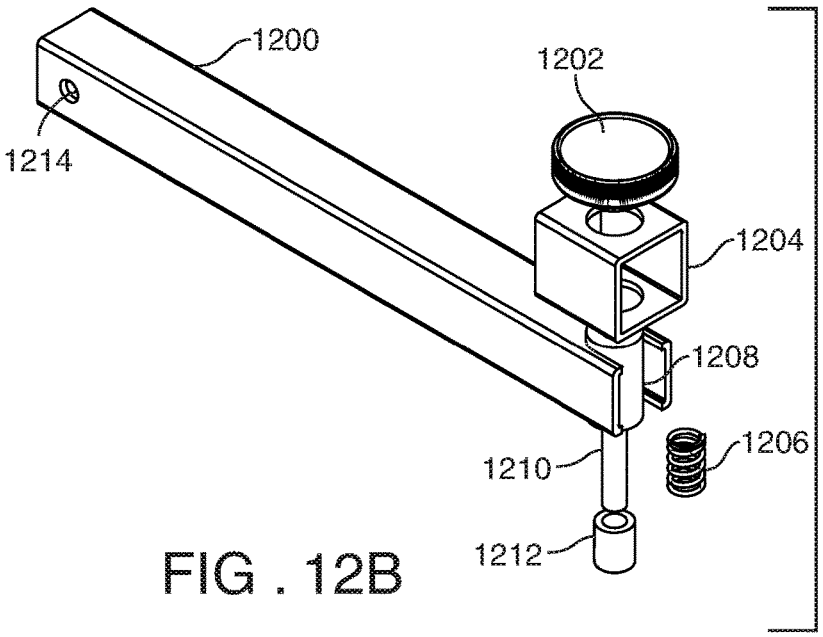

FIG. 12A shows an illustrative central support bar in accordance with principles of the disclosure. FIG. 12B shows an exploded view of the central support bar shown in FIG. 12A. The central support bar may include main bar portion 1200, knob 1202, end tube portion 1204, spring 1206, tube portion 1208, plunger pin 1210, and plunger 1212. Elements 1202-1212 facilitate a spring-loaded knob action which enables a user to pull knob 1202 and thereby retract plunger 1212. Plunger 1212 may lock into an element of a central portion of a transverse support bar assembly (such as locking brace 1410 shown in FIG. 14), thereby locking the table in an unfolded position. Retracting plunger 1212 may unlock the table and allow the legs to be folded.

Figure 12C:
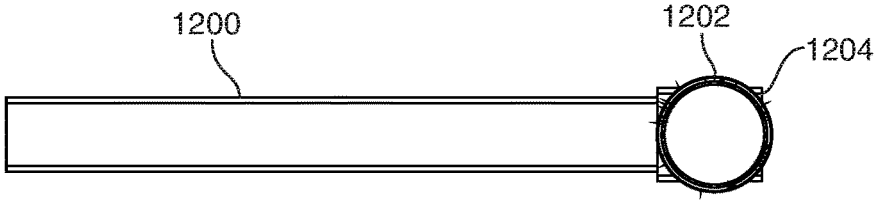
Figure 12D:
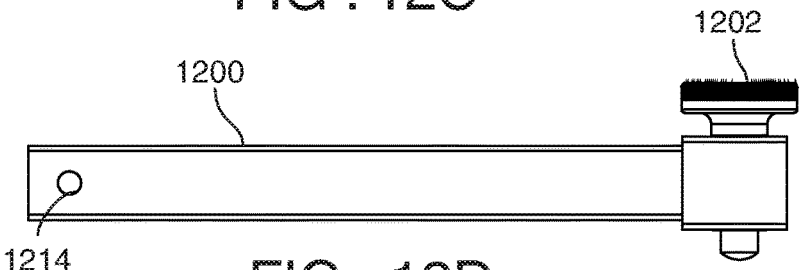
Figure 12E:
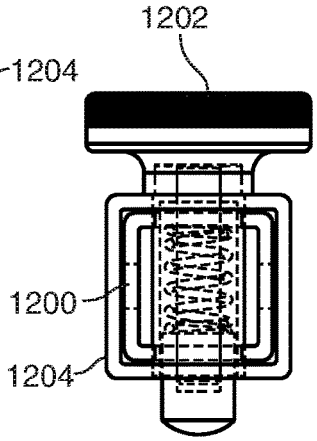

FIGS. 12C-12E show top, side, and front views, respectively, of the illustrative central support bar shown in FIGS. 12A and 12B. Holes 1214 may mate with a suitable fastener to holes on a hinged bracket, such as holes 1106 and 1108 shown in FIG. 11, to connect the central support bar to the underside of the table.

Figure 13A:
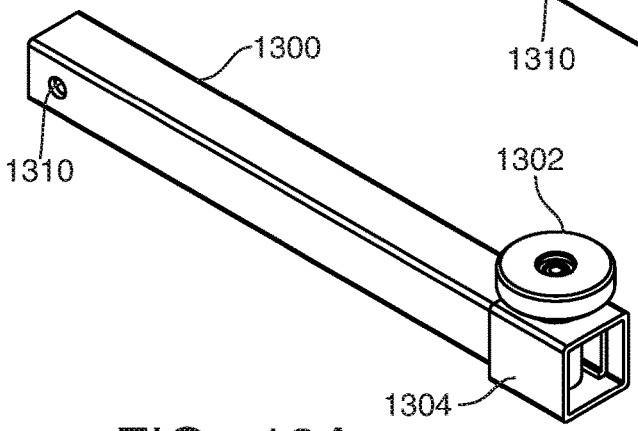
FIGS. 13A-13E show another illustrative apparatus in accordance with principles of the disclosure.
Figure 13B:
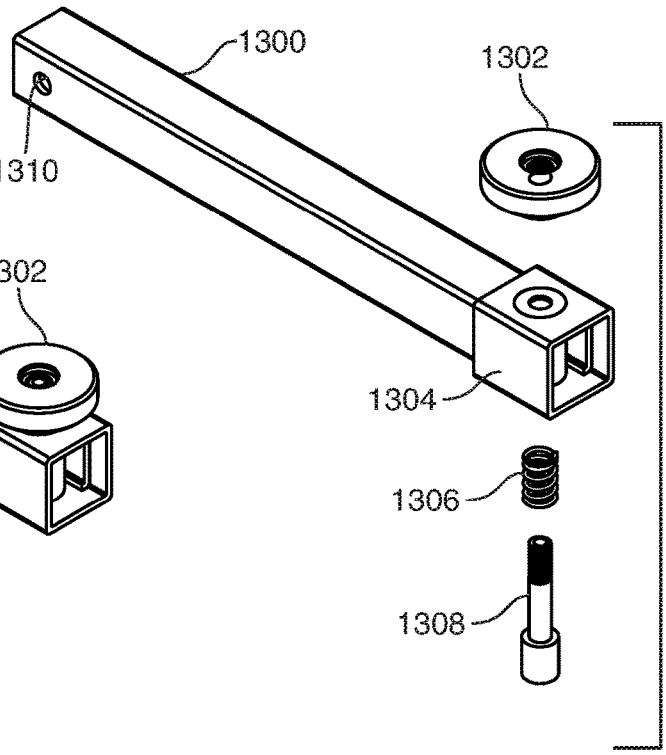

FIG. 13A shows another illustrative central support bar in accordance with principles of the disclosure. FIG. 13B shows an exploded view of the central support bar shown in FIG. 13A. The central support bar may include main bar portion 1300, knob 1302, end tube portion 1304, spring 1306, and plunger assembly 1308. Elements 1302-1308 facilitate a spring-loaded knob action which enables a user to pull knob 1302 and thereby retract plunger 1308. Plunger 1308 may lock into an element of a central portion of a transverse support bar assembly (such as locking brace 1410 shown in FIG. 14), thereby locking the table in an unfolded position. Retracting plunger 1308 may unlock the table and allow the legs to be folded.

Figure 13C:
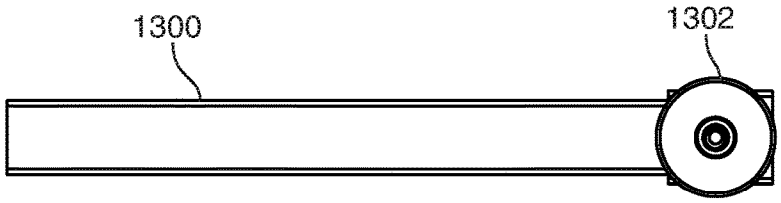
Figure 13D:
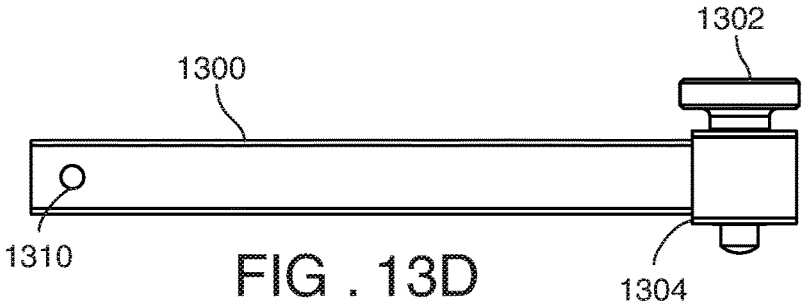
Figure 13E:
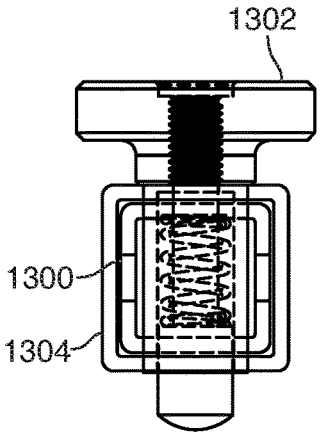

FIGS. 13C-13E show top, side, and front views, respectively, of the illustrative central support bar shown in FIGS. 13A and 13B. Holes 1310 may mate with a suitable fastener to holes on a hinged bracket, such as holes 1106 and 1108 shown in FIG. 11, to connect the central support bar to the underside of the table.

Figure 14A:
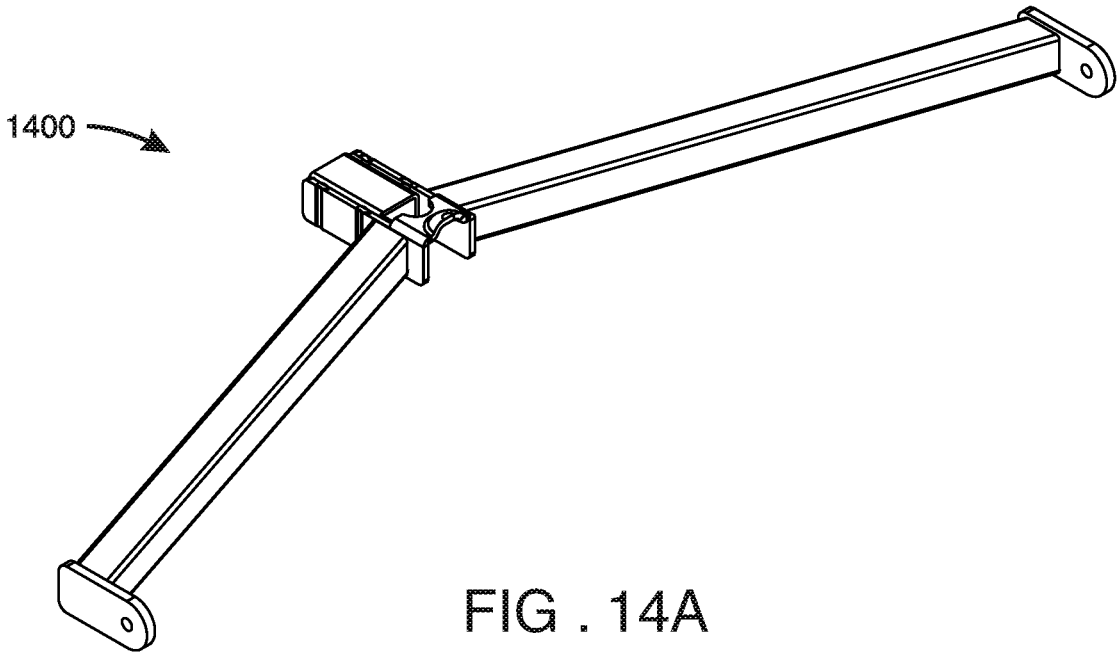
FIGS. 14A and 14B show another illustrative apparatus in accordance with principles of the disclosure.
Figure 14B:
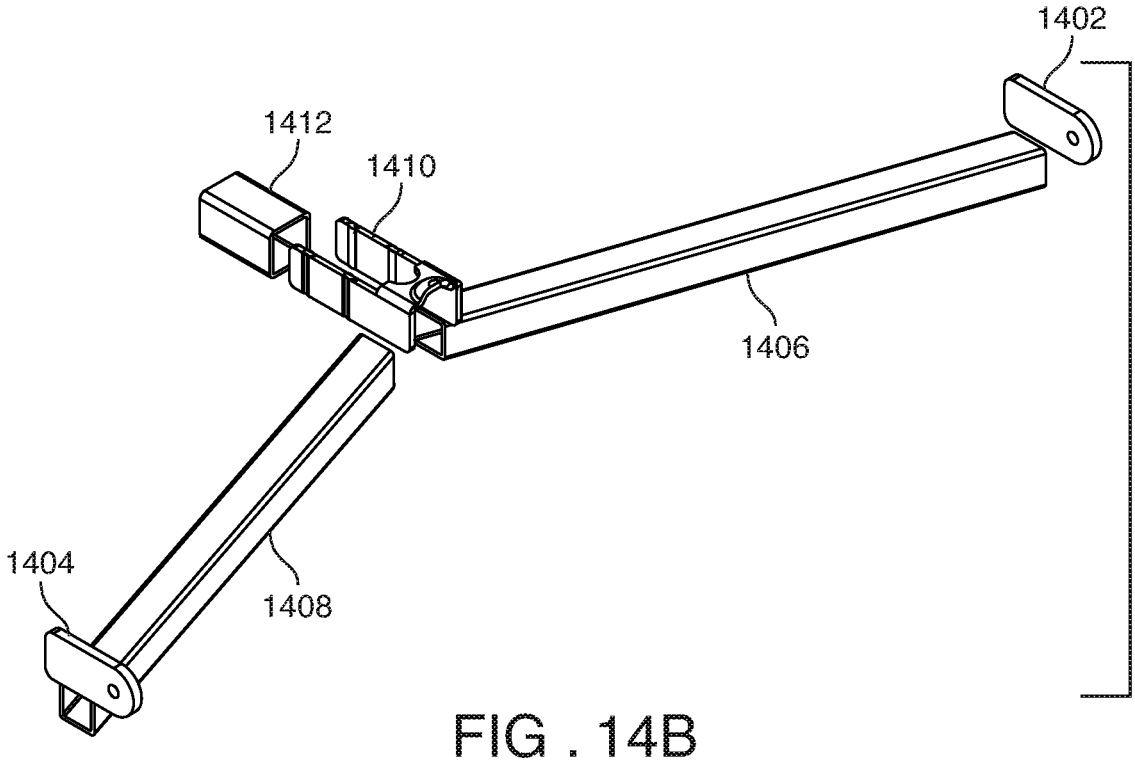

FIG. 14A shows illustrative transverse support bar assembly 1400 in accordance with principles of the disclosure. FIG. 14B shows an exploded view of assembly 1400, including first side support bar 1406, second side support bar 1408, and a central potion including locking brace 1410 and sliding tube 1412. The central support bar (such as the bars shown in FIGS. 12 and 13) may slide through sliding tube 1412, and may lock (e.g., via a spring-loaded knob and plunger of the central support bar) against locking brace 1410 (e.g., into the gap formed between locking brace 1410 and sliding tube 1412).

Tabs 1402 and 1404 may be connected to the ends of first side support bar 1406 and second side support bar 1408, and may in turn connect the side support bars to the table legs. The holes in the tabs for connecting to the table legs may be extended away from the ends of the side support bars, thereby facilitating an offset connection with the legs.

Figure 15:
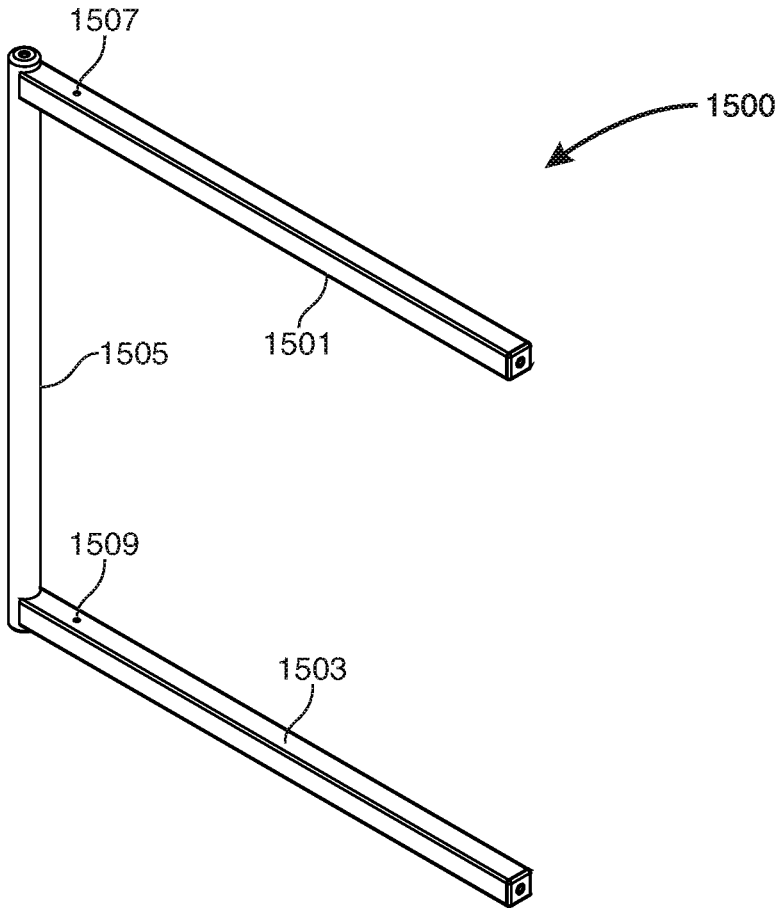
FIG. 15 shows another illustrative apparatus in accordance with principles of the disclosure.

FIG. 15 shows illustrative leg assembly 1500 in accordance with principles of the disclosure. Leg assembly 1500 may include first leg 1501, second leg 1503, and connecting bar 1505. Connecting bar 1505 may be a round tube that connects legs 1501 and 1503. Connecting bar 1505 may form the only direct connection between the legs. The round tube of connecting bar 1505 may be secured to the underside of the table by braces that allow rotational movement of the connecting bar, which thereby may allow the legs to fold and unfold. Holes 1507 and 1509 may be mated with suitable fasteners to side support bars, e.g., via tabs such as tabs 1402 and 1404 shown in FIG. 14. The height of assembly 1500 may be approximately 29", 30" or any other suitable height. The width of assembly 1500 may be approximately 27", or in some embodiments, approximately 1", 2", 3", 4" or any other suitable amount less than the width of the table.

Leg assembly 1500 may be installed at one end of a folding table. Another substantially identical leg assembly may be installed at another end of the table.

Figure 16A:
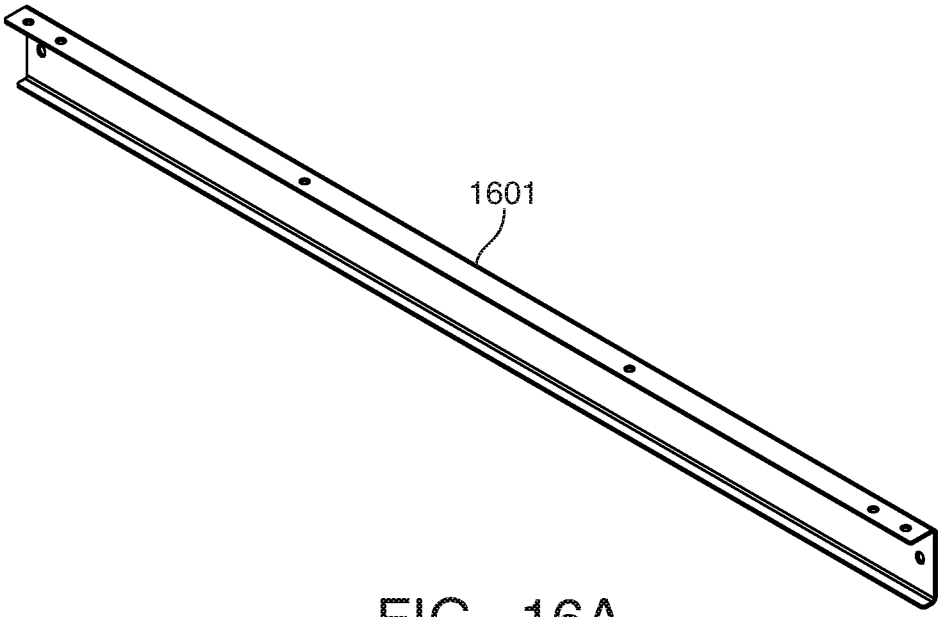
FIGS. 16A-16D show another illustrative apparatus in accordance with principles of the disclosure.
Figure 16B:
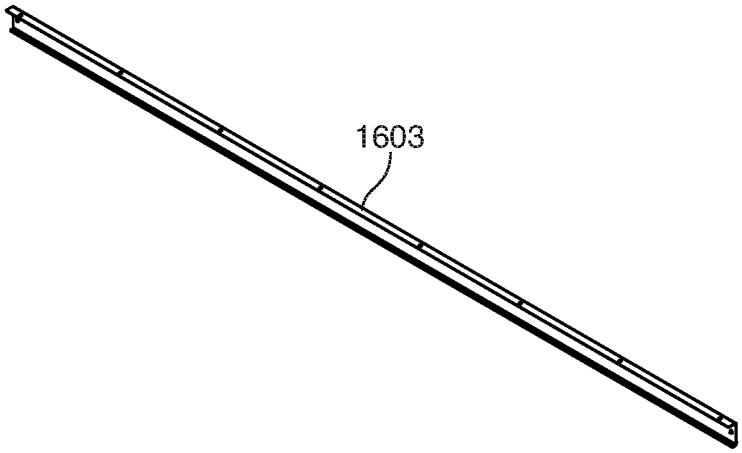

FIGS. 16A-16D show portions of an illustrative skirt assembly in accordance with principles of the disclosure. FIG. 16A shows widthwise portion 1601. Widthwise portion 1601 may be a standalone view of widthwise portion 305 shown in FIG. 3B installed in a table. FIG. 16B shows lengthwise portion 1603. Lengthwise portion 1603 may be a standalone view of lengthwise portion 303 shown in FIG. 3A installed in a table.

Figure 16C:
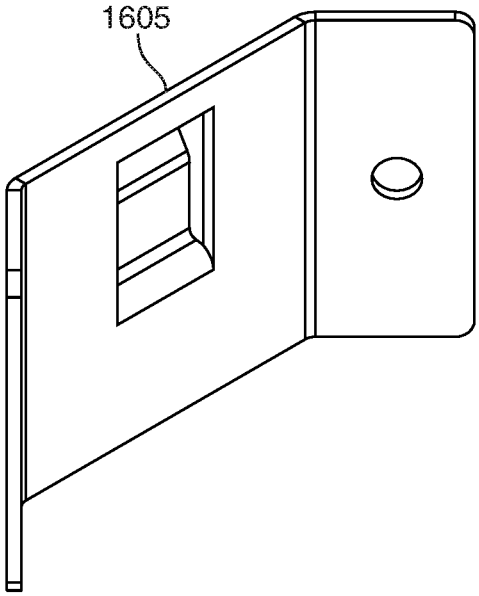

FIG. 16C shows illustrative corner bracket 1605, which may, in certain embodiments, fasten to and connect widthwise portion 1601 and lengthwise portion 1603. A skirt assembly of a rectangular table may have two widthwise and two lengthwise portions, which may be connected at all four corners with four corner brackets. A square table may have four skirt portions of equal lengths. A circular table may also have a skirt assembly made of four equal portions. The skirt assembly of a circular table may follow the perimeter of a reference square inscribed in the circle of the tabletop.

Figure 16D:
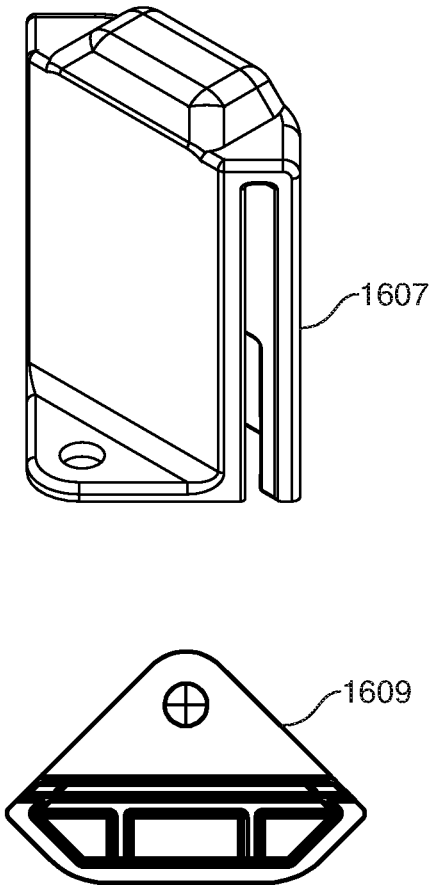

FIG. 16D shows an illustrative side view 1607 and bottom view 1609 of a corner portion of the skirt assembly. The corner portion may be plastic, and may fit over, or next to, corner bracket 1605. The corner portion may extend below the folded legs of the table, and may minimize scratching when folded tables are stacked or placed on a scratchable surface.

Figure 17:
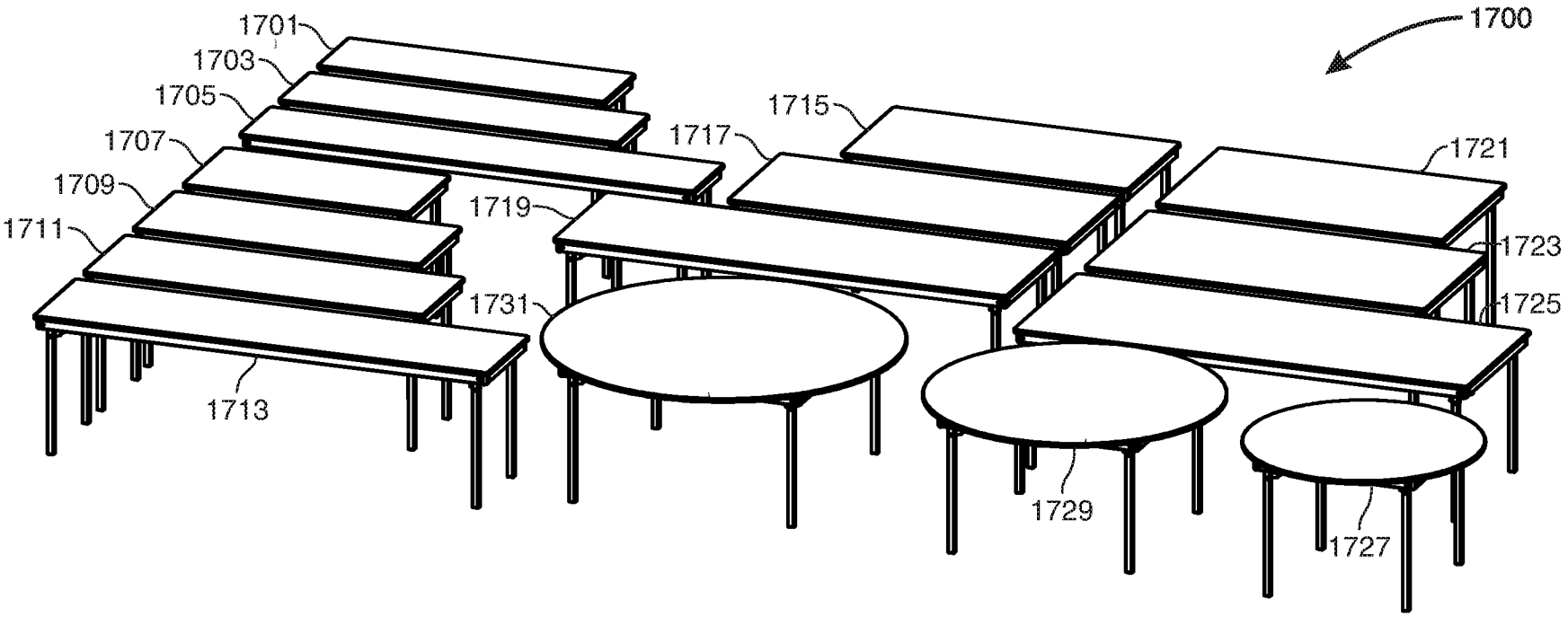
FIG. 17 shows another illustrative apparatus in accordance with principles of the disclosure.

FIG. 17 shows illustrative collection 1700 including some illustrative dimensions of increased seating folding tables in accordance with principles of the disclosure. Dimensions (WxL for a rectangular tabletop, and diameter, or, alternatively, side length of an inscribed square, for a circular tabletop) of tables 1701-1731 may be, respectively: 18"×60", 18"×72", 18"×96", 24"×48", 24"×60", 24"×72", 24"×96", 30"×60", 30"×72", 30"×96", 36"×60", 36"×72", 36"×96", 48", 60", and 72". A height (measured to the underside, or, alternatively, the top, of the tabletop) of some or all of the illustrative models shown in collection 1700 may be approximately 28", 29", 30", 31", 32", or any other suitable folding table height. A substantially exact height measurement may, in certain preferred embodiments, be 29.15".

Figure 18A:
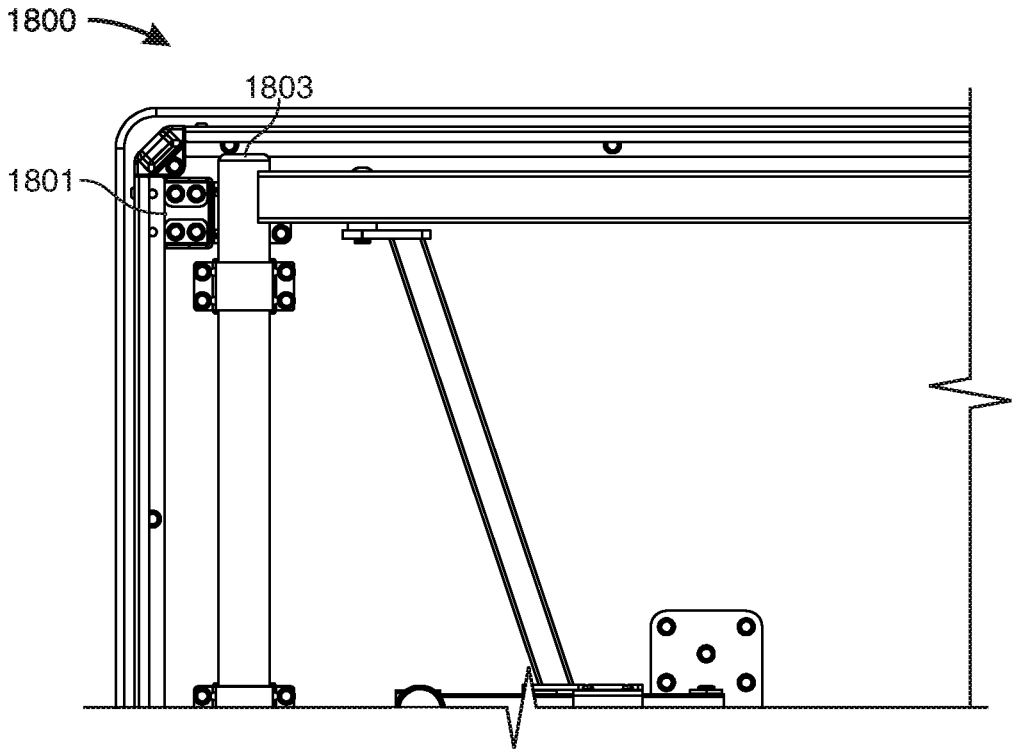
FIGS. 18A and 18B show yet another illustrative apparatus in accordance with principles of the disclosure.
Figure 18B:
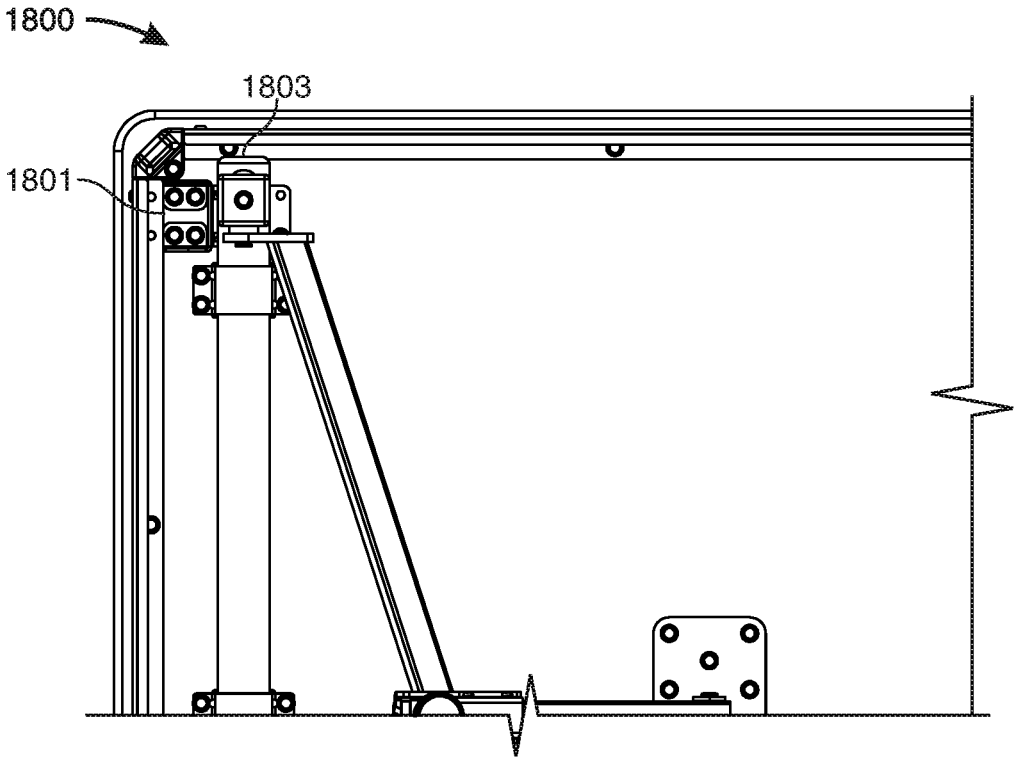

FIGS. 18A and 18B show a portion of illustrative table 1800 in accordance with principles of the disclosure. Table 1800 shows an embodiment of one preferred implementation of portions of folding and support mechanisms for the table. For example, table 1800 includes bump bracket 1801. Bump bracket 1801 (shown in more detail as bracket 1900 in FIG. 19) may provide increased support for the legs of the table, particularly when the legs are in an unfolded position. FIG. 18A is a view with the legs folded and FIG. 18B is a view with the legs unfolded. Connecting bar 1803 shows that in some embodiments the connecting bar may extend past the legs. The extension may facilitate welding clearance.

Figure 19:
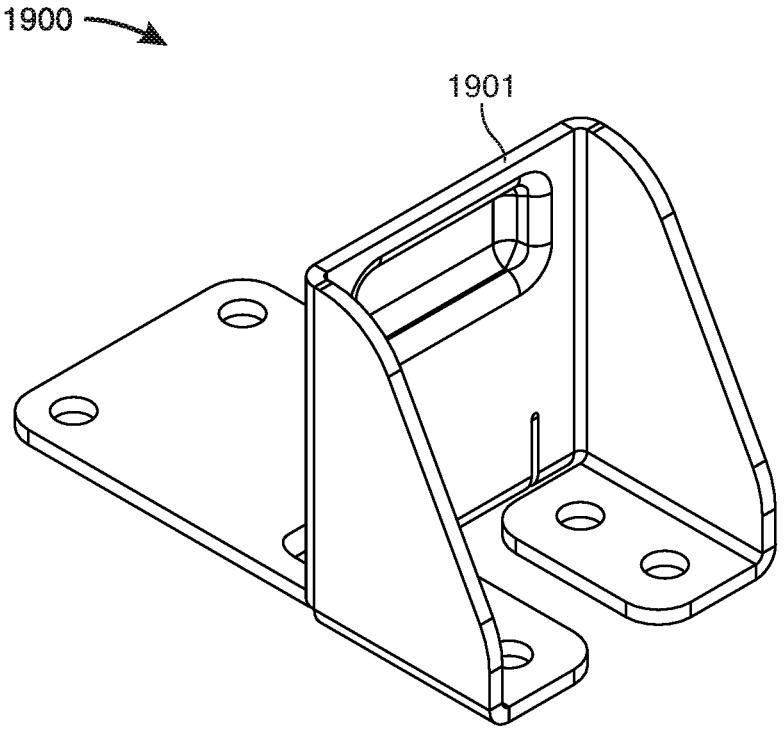
FIG. 19 shows still another illustrative apparatus in accordance with principles of the disclosure.

FIG. 19 shows illustrative bump bracket 1900 in accordance with principles of the disclosure. The flat bottom portion of the bracket may be secured to the underside of the table via the plurality of screw holes shown. Upright portion 1901 may provide increased support for the legs of the table in the unfolded position.

Figure 20A:
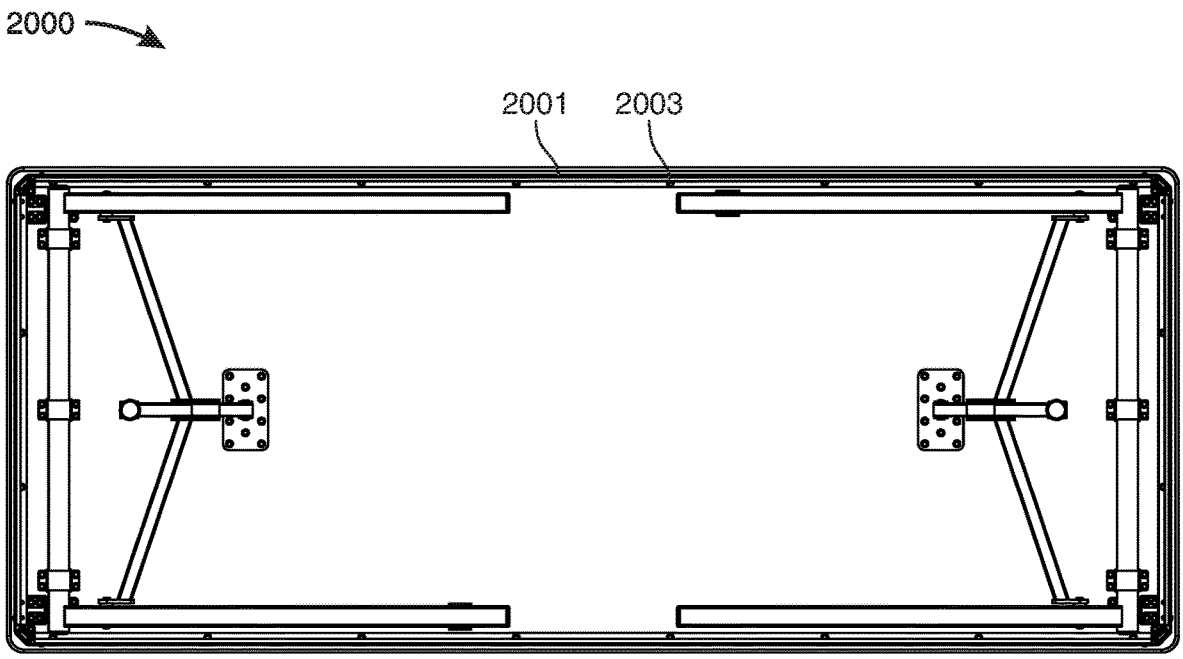
FIGS. 20A and 20B show another illustrative apparatus in accordance with principles of the disclosure.
Figure 20B:
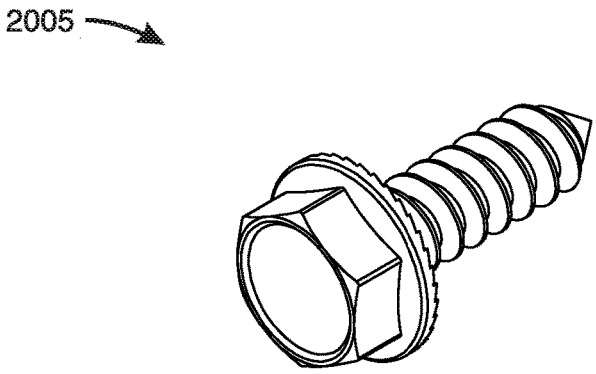

FIG. 20A shows a bottom view of illustrative table 2000 in accordance with principles of the disclosure. Table 2000 shows an embodiment of one exemplary implementation. Specifically, table 2000 shows skirt 2001 secured by a plurality of screws, including screw 2003. One exemplary embodiment of screw 2003 is shown in detail as screw 2005 of FIG. 20B.

The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

Thus, methods and systems for a folding table with increased seating space are provided. Persons skilled in the art will appreciate that the present invention can be practiced by other than the described embodiments, which are presented for purposes of illustration rather than of limitation, and that the present invention is limited only by the claims that follow.

What is claimed is:

1. A folding table with increased seating space, said folding table comprising:

a tabletop;

a plurality of legs affixed to an underside of the tabletop, said legs configured to be movable, bi-directionally, between an unfolded position and a folded position;

a plurality of support brackets, wherein each support bracket:

is secured to the underside of the tabletop adjacent to a corresponding one of the legs; and comprises a portion that:

extends below the underside of the tabletop;

is situated at an outer side of the corresponding one of the legs, said outer side being a side away from which the corresponding one of the legs folds; and provides support for the corresponding one of the legs when the corresponding one of the legs is in the unfolded position, wherein said support is provided via a protrusion that extends from the portion and engages the corresponding one of the legs when the corresponding one of the legs is in the unfolded position; and two or more folding mechanisms, each folding mechanism comprising:

a central support bar affixed to the underside of the tabletop via a hinged bracket; and a transverse support bar assembly, said transverse support bar assembly comprising:

a central portion configured to slide along the central support bar;

a first side support bar that extends from the central portion to one of the legs; and a second side support bar that extends from the central portion to another one of the legs;

wherein:

the plurality of legs comprises four legs;

the tabletop defines four corners, each corner being adjacent to a perimeter of the tabletop;

each one of the four legs is situated at one of the corners;

a first one of the legs that is situated at a first one of the corners is connected to a second one of the legs that is situated at a second one of the corners via a first connecting bar that is situated against the underside of the tabletop and extends from the first one of the legs at the first one of the corners to the second one of the legs at the second one of the corners;

a third one of the legs that is situated at a third one of the corners is connected to a fourth one of the legs that is situated at a fourth one of the corners via a second connecting bar that is situated against the underside of the tabletop and extends from the third one of the legs at the third one of the corners to the fourth one of the legs at the fourth one of the corners; and the first connecting bar forms the only direct connection between the first and second legs and the second connecting bar forms the only direct connection between the third and fourth legs.

2. The folding table of claim 1, wherein the legs are straight.

3. The folding table of claim 1, wherein:

the first connecting bar is secured against the underside of the tabletop via one or more braces, said braces that allow the first connecting bar to rotate in place, and rotation of the first connecting bar allows the first and the second legs to move, in unison, between the folded and unfolded positions; and the second connecting bar is secured against the underside of the tabletop via one or more braces, said braces that allow the second connecting bar to rotate in place, and rotation of the second connecting bar allows the third and the fourth legs to move, in unison, between the folded and unfolded positions.

4. The folding table of claim 1, further comprising a pin assembly configured to lock the central portion of the transverse support bar assembly in place against the central support bar when the legs are in the unfolded position.

5. The folding table of claim 1, wherein the first side support bar is a straight bar that forms an acute angle at a point of attachment with the central portion, and the second side support bar is a straight bar that forms an acute angle at a point of attachment with the central portion, and the transverse support bar assembly thus forms a V-shape.

6. The folding table of claim 1, wherein the first and second side support bars comprise square tubes.

7. The folding table of claim 1, wherein each of the first and second side support bars forms an offset attachment with one of the legs.

8. The folding table of claim 1, wherein the tabletop is rectangular or circular.

9. The folding table of claim 1, further comprising a skirt assembly that follows a perimeter of the tabletop and extends below the underside of the tabletop such that when the legs are in the folded position the skirt assembly extends beyond the legs, thereby minimizing scratching of a top surface of another tabletop upon which the folding table is stacked, wherein the skirt assembly further comprises corner portions that extend further below other portions of the skirt assembly.

10. The table of claim 9 wherein:

the skirt assembly comprises a lengthwise portion along each lengthwise side of the tabletop and a widthwise portion along each widthwise side of the tabletop; and the portion of each support bracket that extends below the underside of the tabletop is situated between the corresponding one of the legs and the widthwise portion of the skirt assembly that is closest to the corresponding one of the legs.

11. The folding table of claim 1, wherein the folding mechanism comprises steel and/or aluminum.

12. The folding table of claim 1, wherein each of the first and second side support bars attaches to one of the legs, and the point of attachment is within four inches below the underside of the tabletop when the legs are in the unfolded position.

13. A method for producing a folding table with increased seating space, said method comprising:

affixing a plurality of legs to an underside of a tabletop; and configuring the legs to be movable, bi-directionally, between an unfolded position and a folded position by installing two or more folding mechanisms, and installing each of the folding mechanisms comprises:

affixing a central support bar to the underside of the tabletop via a hinged bracket;

securing a central portion of a transverse support bar assembly against the central support bar such that the central portion is configured to slide along the central support bar;

attaching one end of a first side support bar of the transverse support bar assembly to the central portion, and another end of the first side support bar to one of the legs; and attaching one end a second side support bar of the transverse support bar assembly to the central portion, and another end of the second side support bar to another one of the legs; and the method further comprises:

securing each of a plurality of support brackets to the underside of the tabletop adjacent to a corresponding one of the legs, wherein each support bracket comprises a portion that:

extends below the underside of the tabletop;

is situated at an outer side of the corresponding one of the legs, said outer side being a side away from which the corresponding one of the legs folds; and provides support for the corresponding one of the legs when the corresponding one of the legs is in the unfolded position, wherein said support is provided via a protrusion that extends from the portion and engages the corresponding one of the legs when the corresponding one of the legs is in the unfolded position;

connecting a first one of the legs to a second one of the legs via a first connecting bar that is situated against the underside of the tabletop;

connecting a third one of the legs to a fourth one of the legs via a second connecting bar that is situated against the underside of the tabletop;

securing the first connecting bar against the underside of the tabletop via one or more braces, said braces that allow the first connecting bar to rotate in place about a central longitudinal axis of the first connecting bar, wherein rotation of the first connecting bar allows the first and the second legs to move, in unison, between the folded and unfolded positions; and securing the second connecting bar against the underside of the tabletop via one or more braces, said braces that allow the second connecting bar to rotate in place about a central longitudinal axis of the second connecting bar, wherein rotation of the second connecting bar allows the third and the fourth legs to move, in unison, between the folded and unfolded positions; and wherein:

the first connecting bar forms the only direct connection between the first and second legs and the second connecting bar forms the only direct connection between the third and fourth legs.

14. The method of claim 13, wherein:

the first side support bar is a straight bar that forms an acute angle at a point of attachment with the central portion, and the second side support bar is a straight bar that forms an acute angle at a point of attachment with the central portion, and the transverse support bar assembly thus forms a V-shape;

the first and second side support bars comprise square tubes; and each of the first and second side support bars forms an offset attachment with one of the legs, and the offset attachment is within four inches below the underside of the tabletop when the legs are in the unfolded position.

15. The method of claim 13, wherein:

the plurality of legs comprises four legs, and each of the legs is straight;

the tabletop defines four corners, each corner being adjacent to a perimeter of the tabletop; and each one of the four legs is situated at one of the four corners.

16. The method of claim 13, further comprising installing:

a pin assembly configured to lock the central portion of the transverse support bar assembly in place against the central support bar when the legs are in the unfolded position; and a skirt assembly that follows a perimeter of the tabletop and extends below the underside of the tabletop such that when the legs are in the folded position the skirt assembly extends beyond the legs, thereby minimizing scratching of a top surface of another tabletop upon which the folding table is stacked, wherein the skirt assembly further comprises corner portions that extend further below other portions of the skirt assembly.

17. The method of claim 16 wherein:

the skirt assembly comprises a lengthwise portion along each lengthwise side of the tabletop and a widthwise portion along each widthwise side of the tabletop; and the portion of each support bracket that extends below the underside of the tabletop is situated between the corresponding one of the legs and the widthwise portion of the skirt assembly that is closest to the corresponding one of the legs.

18. A folding table, said table comprising:

a tabletop, said tabletop defining four corners, each corner being adjacent to a perimeter of the tabletop;

four straight legs affixed to an underside of the tabletop, said legs configured to be movable, bi-directionally, between an unfolded position and a folded position, wherein each one of the four legs is situated at one of the four corners;

a plurality of support brackets, wherein each support bracket:

is secured to the underside of the tabletop adjacent to a corresponding one of the legs; and comprises a portion that:

extends below the underside of the tabletop;

is situated at an outer side of the corresponding one of the legs, said outer side being a side away from which the corresponding one of the legs folds; and provides support for the corresponding one of the legs when the corresponding one of the legs is in the unfolded position, wherein said support is provided via a protrusion that extends from the portion and engages the corresponding one of the legs when the corresponding one of the legs is in the unfolded position; and two or more folding mechanisms, each folding mechanism comprising:

a central support bar affixed to the underside of the tabletop via a hinged bracket; and a transverse support bar assembly, said transverse support bar assembly comprising:

a central portion configured to slide along the central support bar;

a first side support bar that extends from the central portion to one of the legs; and a second side support bar that extends from the central portion to another one of the legs;

wherein:

the first side support bar is a straight bar that forms an acute angle at a point of attachment with the central portion, and the second side support bar is a straight bar that forms an acute angle at a point of attachment with the central portion, and the transverse support bar assembly thus forms a V-shape; and each of the first and second side support bars forms an offset attachment with one of the legs, and the point of attachment is within four inches below the underside of the tabletop when the legs are in the unfolded position.

19. The table of claim 18, wherein:

a first one of the legs that is situated at a first one of the corners is connected to a second one of the legs that is situated at a second one of the corners via a first connecting bar that is situated against the underside of the tabletop and extends from the first one of the legs at the first one of the corners to the second one of the legs at the second one of the corners;

the first connecting bar is secured against the underside of the tabletop via one or more braces, said braces that allow the first connecting bar to rotate in place, and rotation of the first connecting bar allows the first and the second legs to move, in unison, between the folded and unfolded positions;

a third one of the legs that is situated at a third one of the corners is connected to a fourth one of the legs that is situated at a fourth one of the corners via a second connecting bar that is situated against the underside of the tabletop and extends from the third one of the legs at the third one of the corners to the fourth one of the legs at the fourth one of the corners;

the second connecting bar is secured against the underside of the tabletop via one or more braces, said braces that allow the second connecting bar to rotate in place, and rotation of the second connecting bar allows the third and the fourth legs to move, in unison, between the folded and unfolded positions; and the first and the second connecting bars form the only connections between the legs.

20. The table of claim 18, further comprising:

a pin assembly configured to lock the central portion of the transverse support bar assembly in place against the central support bar when the legs are in the unfolded position; and a skirt assembly that follows a perimeter of the tabletop and extends below the underside of the tabletop such that when the legs are in the folded position the skirt assembly extends beyond the legs, thereby minimizing scratching of a top surface of another tabletop upon which the folding table is stacked, wherein the skirt assembly further comprises corner portions that extend further below other portions of the skirt assembly.

21. The table of claim 20 wherein:

the skirt assembly comprises a lengthwise portion along each lengthwise side of the tabletop and a widthwise portion along each widthwise side of the tabletop; and the portion of each support bracket that extends below the underside of the tabletop is situated between the corresponding one of the legs and the widthwise portion of the skirt assembly that is closest to the corresponding one of the legs.

22. The table of claim 18, wherein the first and second side support bars comprise square tubes.

* * * * *